US009158213B2

(12) United States Patent
Taniguchi et al.

(10) Patent No.: US 9,158,213 B2
(45) Date of Patent: Oct. 13, 2015

(54) CHARGING MEMBER, PROCESS CARTRIDGE AND ELECTROPHOTOGRAPHIC APPARATUS

(71) Applicant: CANON KABUSHIKI KAISHA, Tokyo (JP)

(72) Inventors: Tomohito Taniguchi, Suntou-gun (JP); Takehiko Aoyama, Suntou-gun (JP); Taichi Sato, Numazu (JP); Noboru Miyagawa, Suntou-gun (JP); Satoshi Koide, Otsu (JP); Daisuke Tanaka, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/315,314

(22) Filed: Jun. 25, 2014

(65) Prior Publication Data

US 2014/0308607 A1 Oct. 16, 2014

Related U.S. Application Data

(63) Continuation of application No. PCT/JP2013/005670, filed on Sep. 25, 2013.

(30) Foreign Application Priority Data

Jan. 29, 2013 (JP) ..... 2013-014877
Jun. 24, 2013 (JP) ..... 2013-131729
Jul. 23, 2013 (JP) ..... 2013-152790

(51) Int. Cl.
*G03G 5/04* (2006.01)
*G03G 5/07* (2006.01)
*G03G 15/02* (2006.01)

(52) U.S. Cl.
CPC ..... *G03G 5/071* (2013.01); *G03G 5/04* (2013.01); *G03G 15/0233* (2013.01); *Y10T 428/25* (2015.01)

(58) Field of Classification Search
CPC ..... G03G 5/04; G03G 15/0233; C08K 7/22
See application file for complete search history.

(56) References Cited

U.S. PATENT DOCUMENTS 8,725,043 B2 5/2014 Hoshio
2010/0104316 A1* 4/2010 Hoshio et al. ..... 399/100

(Continued)

FOREIGN PATENT DOCUMENTS

JP 3278016 B2 4/2002
JP 2003-316112 A 11/2003

(Continued)

OTHER PUBLICATIONS

PCT International Search Report and Written Opinion of the International Searching Authority, International Application No. JP2013/005670, Mailing Date Nov. 12, 2013.

(Continued)

*Primary Examiner* — Elizabeth A Robinson
(74) *Attorney, Agent, or Firm* — Fitzpatrick, Cella, Harper and Scinto

(57) ABSTRACT

The present invention relates to a charging member. The charging member comprises an electro-conductive substrate and an electro-conductive surface layer, wherein the surface layer includes a binder resin, an electro-conductive particle dispersed in the binder resin, and a resin particle that roughens the surface of the surface layer; the surface layer has a plurality of protrusions each derived from the resin particle in the surface thereof; the resin particle that forms the protrusion has a pore inside thereof; has a porosity Vt of porosity is 2.5% by volume or less as a whole; and has a region whose porosity V11 is from 5% by volume to 20% by volume, wherein the region is farthest away from the electro-conductive substrate in the resin particle, and assuming that the resin particle is a solid particle having no pores, the region corresponds to a 11% by volume-occupying region of the solid particle.

13 Claims, 6 Drawing Sheets

(56) References Cited

U.S. PATENT DOCUMENTS

| | | | |
|---|---|---|---|
| 2013/0236214 | A1 | 9/2013 | Koide et al. |
| 2014/0270853 | A1 | 9/2014 | Uematsu et al. |
| 2014/0274628 | A1 | 9/2014 | Matsuda et al. |

FOREIGN PATENT DOCUMENTS

| | | | |
|---|---|---|---|
| JP | 2008-276026 | A | 11/2008 |
| JP | 2009-175427 | A | 8/2009 |
| JP | 2010-113177 | A | 5/2010 |
| JP | 2010-181819 | A | 8/2010 |
| JP | 2010-231007 | A | 10/2010 |
| JP | 2012-168259 | A | 9/2012 |
| JP | 2012-173360 | A | 9/2012 |

OTHER PUBLICATIONS

Taniguchi, et al., U.S. Appl. No. 14/336,917, filed Jul. 21, 2014.
Sato, et al., U.S. Appl. No. 14/338,107, filed Jul. 22, 2014.
International Preliminary Report on Patentability, International Application No. PCT/JP2013/005670 Mailing Date Aug. 13, 2015.

* cited by examiner

CHARGING MEMBER, PROCESS CARTRIDGE AND ELECTROPHOTOGRAPHIC APPARATUS

CROSS-REFERENCE TO RELATED APPLICATIONS

This application is a continuation of International Application No. PCT/JP2013/005670, filed Sep. 25, 2013, which claims the benefit of Japanese Patent Application No. 2013-014877, filed Jan. 29, 2013, Japanese Patent Application No. 2013-131729, filed Jun. 24, 2013, and Japanese Patent Application No. 2013-152790, filed Jul. 23, 2013.

BACKGROUND OF THE INVENTION

1. Field of the Invention

The present invention relates to a charging member for charging the surface of an electrophotographic photosensitive member as a member to be charged up to a predetermined potential by applying voltage to the charging member, and a process cartridge and electrophotographic image forming apparatus (hereinafter referred to as an "electrophotographic apparatus") using the charging member.

2. Description of the Related Art

An electrophotographic apparatus using electrophotography mainly includes an electrophotographic photosensitive member, a charging apparatus, an exposure apparatus, a developing apparatus, a transfer apparatus, a cleaning apparatus, and a fixing apparatus. For the charging apparatus, contact charging apparatuses are often used which apply voltage (voltage of only DC voltage or voltage of AC voltage superimposed onto DC voltage) to the charging member disposed in contact with or in the vicinity of the surface of the electrophotographic photosensitive member to charge the surface of the electrophotographic photosensitive member.

For more stable charging of the electrophotographic photosensitive member by contact charging, Japanese Patent Application Laid-Open No. 2003-316112 and Japanese Patent Application Laid-Open No. 2009-175427 disclose charging members for contact charging including a surface layer having a protrusion derived from a resin particle or the like in the surface of the surface layer. Use of such a charging member leads to more stable charging of the electrophotographic photosensitive member. As a result, unevenness in an electrophotographic image, that is, horizontal streaks, which may be produced due to ununiform charging of the electrophotographic photosensitive member, can be suppressed.

The reason of stable charging of the electrophotographic photosensitive member by using the charging member having the protrusions formed in the surface thereof leads is presumed that protrusions form slight gaps in a nip between the charging member and the electrophotographic photosensitive member, and discharge occurs in the gaps (Japanese Patent Application Laid-Open No. 2008-276026).

SUMMARY OF THE INVENTION

According to the research by the present inventors, as described in Japanese Patent Application Laid-Open No. 2003-316112 and Japanese Patent Application Laid-Open No. 2009-175427, contact pressure concentrates on the protrusions when the charging member including the surface layer having the protrusion derived from the resin particle formed in the surface layer is brought into contact with the photosensitive member. As a result, when a slip occurs between the charging member and the electrophotographic photosensitive member, the surface of the electrophotographic photosensitive member may be scratched.

The toner remaining on the electrophotographic photosensitive member after the transferring step (hereinafter also referred to as a "remaining toner") should originally be removed by a cleaning blade or the like in the cleaning step. However, when the surface of the photosensitive member is scratched as described above, the remaining toner may escape the cleaning blade at the scratched portions, and remain on the photosensitive member even after the cleaning step is performed. The toner may cause unevenness, that is, vertical streaks in a solid white portion in the electrophotographic image to be formed in the next electrophotographic image forming cycle. The electrophotographic image having unevenness, that is, vertical streaks may be referred to as an "image with vertical streaks."

The photosensitive member is more likely to be scratched as described above these days along with increase in the life of the electrophotographic image forming apparatus, the number of outputs of the electrophotographic image, and the speed of the electrophotographic image forming process.

Then, the present invention is directed to providing a charging member that has a high charging ability and hardly produces scratches on the surface of the electrophotographic photosensitive member. Further, the present invention is directed to providing a process cartridge and electrophotographic apparatus useful for stable formation of a high-quality electrophotographic image.

According to one aspect of the present invention, there is provided a charging member comprising an electro-conductive substrate and an electro-conductive surface layer, wherein: the surface layer includes a binder resin, an electro-conductive particle dispersed in the binder resin, and a resin particle that roughens the surface of the surface layer; the surface layer has a plurality of protrusions each derived from the resin particle in the surface thereof; the resin particle that forms each of the protrusion has a pore inside thereof, has a porosity Vt of 2.5% by volume or less as a whole, and has a region whose porosity $V_{11}$ is 5% by volume or more and 20% by volume or less, wherein the region is farthest away from the electro-conductive substrate in the resin particle, and assuming that the resin particle is a solid particle having no pores, the region corresponds to a 11% by volume-occupying region of the solid particle.

According to another aspect of the present invention, there is provided a process cartridge detachably mountable on a main body of an electrophotographic apparatus, wherein the afore-mentioned charging member is integrated with at least a member to be charged.

According to further aspect of the present invention, there is provided an electrophotographic apparatus including the afore-mentioned charging member and a member to be charged.

The present invention can provide a charging member that has a high charging ability and hardly produces scratches on the surface of the electrophotographic photosensitive member. Moreover, the present invention can provide a process cartridge and electrophotographic apparatus useful for stable formation of a high-quality electrophotographic image.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Figure 1A:
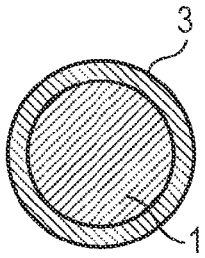
FIG. 1A is a sectional view illustrating a charging member (charging roller) having a roller shape according to the present invention.
Figure 1B:
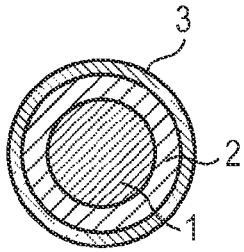
FIG. 1B is a sectional view illustrating a charging member (charging roller) having a roller shape according to the present invention.
Figure 1C:
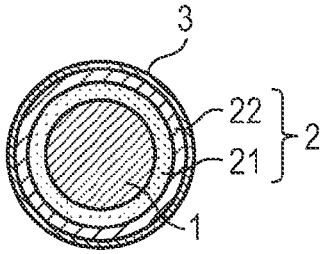
FIG. 1C is a sectional view illustrating a charging member (charging roller) having a roller shape according to the present invention.

In FIG. 1A, one example of the cross section of the charging member according to the present invention is shown. The charging member includes an electro-conductive substrate 1 and an electro-conductive surface layer 3 that is a coating on the circumferential surface of the electro-conductive substrate 1. As shown in FIGS. 1B and 1C, the charging member according to the present invention can include one or more conductive elastic layers 2 disposed between the electro-conductive substrate 1 and the electro-conductive surface layer 3. The electro-conductive substrate 1 may be bonded to a layer sequentially laminated on the electro-conductive substrate (such as the electro-conductive surface layer 3 shown in FIG. 1A, the electro-conductive elastic layer 2 shown in FIG. 1B, and the electro-conductive elastic layer 21 shown in FIG. 1C) with an electro-conductive adhesive agent. In order for the adhesive agent to be electro-conductive, any kind of known conductive agent can be used. The electro-conductive adhesive can also be used to bond the electro-conductive elastic layer 2 to the electro-conductive surface layer 3 shown in FIG. 1B and bond the electro-conductive elastic layer 21 to the electro-conductive elastic layer 22 shown in FIG. 1C.

Figure 2:
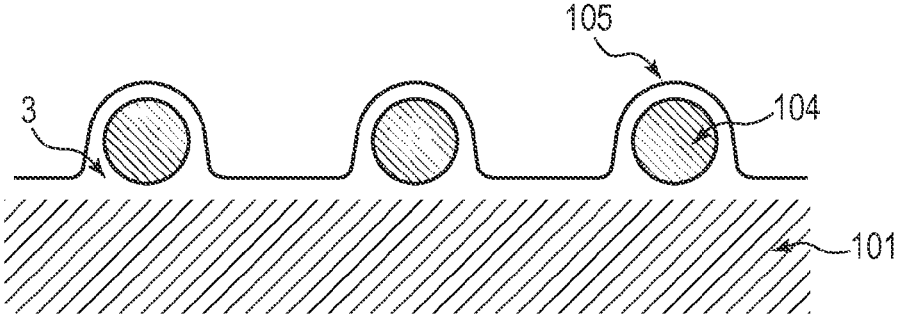
FIG. 2 is a partial sectional view illustrating a charging member according to the present invention.

FIG. 2 is a partial sectional view showing the charging member according to the present invention. The surface layer 3 on the substrate 101, includes a binder resin (not shown), an electro-conductive particle dispersed in the binder resin (not shown), and a resin particle 104 for roughening the surface of the surface layer. The surface layer 3 has a plurality of protrusions 105 each derived from the resin particle 104 in the surface of the surface layer 3.

Figure 3:
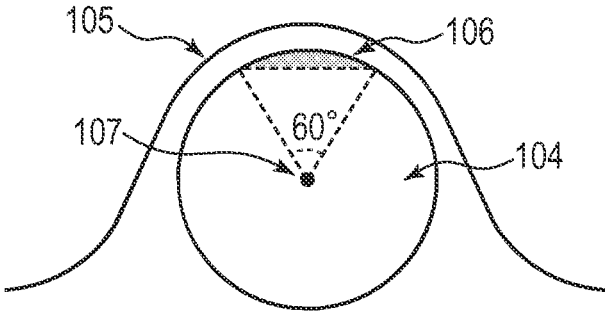
FIG. 3 is a schematic view illustrating a cross sectional image of a protrusion in an electro-conductive surface layer according to the present invention.

FIG. 3 is an enlarged sectional view of the protrusion 105. The resin particle 104 that forms the protrusion 105 has a pore inside thereof. The resin particle has a porosity Vt of 2.5% by volume or less as a whole.

The resin particle has a region whose porosity V11 is 5% by volume or more and 20% by volume or less, the region being farthest away from the electro-conductive substrate in the resin particle, and assuming that the resin particle is a solid particle having no porosity, the region corresponds to a 11% by volume-occupying region of the solid particle. Regarding the resin particle that forms the protrusion in the surface layer in the charging member, assuming that the resin particle is a solid particle having no porosity, the region in the resin particle corresponding to the 11% by volume-occupying region of the solid particle, may be referred to as "vertex side region of the protrusion" hereinafter. The "vertex side region of the protrusion" is specifically a region 106 in FIG. 3.

The present inventors studied the contact state and discharging state when the conventional charging member whose surface was roughened by a solid resin particle charged the electrophotographic photosensitive member. In the process, the nip portion between the charging member and the electrophotographic photosensitive member was observed in detail. As a result, it was found that in the charging member having the protrusion derived from the resin particle or the like, the portion close to the vertex of the protrusion contacts the electrophotographic photosensitive member within the nip, and a slight gap is formed in a depressed portion between the protrusions. It was also found that in the slight gap, a discharge phenomenon from the surface of the charging member to the surface of the electrophotographic photosensitive member occurs.

Meanwhile, the contact between the electrophotographic photosensitive member and the charging member is limited to a narrow region around the portion close to the vertex of the protrusion. It was found that particularly when an electrophotographic image is formed at a high speed in such a state, a slip occurs in the contact portion close to the vertex of the protrusion. Furthermore, it was found that the slip causes scratches several micrometers deep in the surface of the electrophotographic photosensitive member.

Further studies by the present inventors revealed that in the cleaning step, the toner remaining on the electrophotographic photosensitive member after the transferring step may escape the cleaning blade in the scratched portion of the surface of the electrophotographic photosensitive member. It was found that particularly a low temperature and low humidity environment enhances the fluidity of the toner to promote escape of the toner. Furthermore, it was found that the toner escapes more remarkably when a toner having a sphere-like shape is used.

As a result of studies by the present inventors, it was found that no scratches are produced when the protrusion is not formed. In this case, however, it was found that no discharge within the nip occurs, and improvement in charging performance is difficult.

Then, the present inventors studied to produce discharge within the nip and suppress scratches produced in the surface of the electrophotographic photosensitive member due to contact with the protrusions. In the process, it was found that if a plurality of pores are formed inside of the resin particle that forms the protrusion, the resin particle is easy to deform to enlarge the contact area of the protrusions in the charging member and the electrophotographic photosensitive member. As the resin particle has a larger porosity, the protrusion can deform more greatly to enlarge the contact area between the protrusion and the electrophotographic photosensitive member. This relaxes concentration of the pressure applied to the portion close to the vertex of the protrusion, and can suppress the slip. As the resin particle has an excessively large porosity, the slight gap is difficult to form in the nip portion. Namely, discharge within the nip is difficult to occur.

As a result of further studies by the present inventors, it was found that if the porosities inside of the resin particle are concentrated in the portion close to the vertex of the protrusion, the slip can be suppressed and discharge within the nip can be kept.

Namely, it was found that the problems above can be solved if the resin particle that forms the protrusion meets the following requirements (i) and (ii):

(i) the resin particle has a porosity inside thereof, and the resin particle has a porosity Vt of 2.5% by volume or less as a whole; and (ii) the porosity $V_{11}$ in the "vertex side region of the protrusion" (namely, the region 106 in FIG. 3) is 5% by volume or more and 20% by volume or less.

The numeric value of the porosity in the resin particle described above numerically indicates that the pores concentrate in the portion close to the vertex of the protrusion formed in the surface of the charging member, particularly the contact portion between the electrophotographic photosensitive member and the protrusions in the surface of the charging member. The method of measuring the porosity will be described in detail later.

The resin particle has a porosity Vt of 2.5% by volume or less as a whole. Within this range, the discharge within the nip can be kept. A more preferred range is 2.0% by volume or less. Thereby, the discharge within the nip can be kept more easily.

The porosity $V_{11}$ in the "vertex side region of the protrusion" is 5% by volume or more and 20% by volume or less. Within this range, the slip can be suppressed. A more preferred range is 5.5% by volume or more and 15% by volume or less. Thereby, the slip can be more easily suppressed.

In the thus-configured charging member, only the portion close to the vertex of the protrusion existing in the surface of the charging member easily deforms to enlarge the contact area between the charging member and the surface of the electrophotographic photosensitive member. Thereby, the contact pressure can be relaxed to suppress production of the slip and thus suppress production of the scratches. The present inventors presume that production of the image with vertical streaks is thus suppressed.

Meanwhile, because the porosity Vt in the entire resin particle is smaller than the porosity $V_{11}$ in the "vertex side region of the protrusion," the protrusions in the charging member are difficult to deform, and the gap between the charging member and the electrophotographic photosensitive member is kept. Thereby, discharge within the nip can occur. The present inventors presume that discharge within the nip can be kept and production of the scratches is suppressed by these effects. Here, it was also found that to stably keep discharge intensity within the nip and to prevent abnormal discharge, an electro-conductive particle needs to be dispersed in the binder resin included in the surface layer.

<Electro-Conductive Substrate>

The electro-conductive substrate used in the charging member according to the present invention has conductivity, and has a function of supporting the electro-conductive surface layer and the like formed thereon. Examples of the material for the electro-conductive substrate can include metals such as iron, copper, stainless steel, aluminum and nickel, and alloys thereof. To give scratch resistance to the surface of the electro-conductive substrate, the surface may be plated provided that the conductivity is not impaired. Furthermore, as the electro-conductive substrate, resin-base substrates whose surface is coated with a metal to make the surface conductive or substrates made of an electro-conductive resin composition can also be used.

<Electro-Conductive Surface Layer>

[Binder Resin]

For the binder resin used for the electro-conductive surface layer according to the present invention, a known rubber or resin can be used. Examples of rubber can include natural rubber, vulcanized natural rubber, and synthetic rubber.

Examples of synthetic rubber include: ethylene propylene rubber, styrene butadiene rubber (SBR), silicone rubber, urethane rubber, isoprene rubber (IR), butyl rubber, acrylonitrile butadiene rubber (NBR), chloroprene rubber (CR), acrylic rubber, epichlorohydrin rubber, and fluorocarbon rubber.

As the resin, thermosetting resins and thermoplastic resins and the like can be used, for example. Among these, fluorinated resin, polyamide resin, acrylic resin, polyurethane resin, acrylic urethane resin, silicone resin, and butyral resin are more preferred.

These may be used singly or in combinations of two or more. Further, monomers that are raw materials for these resins may be copolymerized and used as copolymers. Among these, the resins listed above can be used as the binder resin. This is because these resins can control adhesion to the electrophotographic photosensitive member and friction properties more easily. The electro-conductive surface layer may be formed by adding a crosslinking agent and the like to a prepolymer as a raw material of a binder resin, and curing or crosslinking the prepolymer. Herein, the mixture containing the crosslinking agent and the like will also be referred to as the "binder resin".

[Resin Particle]

The resin particle that forms the protrusion in the surface layer of the charging member according to the present invention is a porous resin particle having the afore-mentioned porosity. Examples of the material for the resin particle include high molecular compounds: resins such as acrylic resin, styrene resin, polyamide resin, silicone resin, vinyl chloride resin, vinylidene chloride resin, acrylonitrile resin, fluorinated resin, phenol resin, polyester resin, melamine resin, urethane resin, olefin resin, epoxy resin, copolymers, modified products, and derivatives thereof; and thermoplastic elastomers such as ethylene-propylene-diene copolymer (EPDM), styrene-butadiene copolymerization rubber (SBR), silicone rubber, urethane rubber, isoprene rubber (IR), butyl rubber, chloroprene rubber (CR), polyolefin thermoplastic elastomers, urethane thermoplastic elastomers, polystyrene thermoplastic elastomers, fluorocarbon rubber thermoplastic elastomers, polyester thermoplastic elastomers, polyamide thermoplastic elastomers, polybutadiene thermoplastic elastomers, ethylene vinyl acetate thermoplastic elastomers, polyvinyl chloride thermoplastic elastomers, and chlorinated polyethylene thermoplastic elastomers. The resin particles formed of these high molecular compounds are easy to disperse in the binder resin. Among these, one or more resins selected from the group consisting of acrylic resin, styrene resin, and acrylic styrene resin are more preferably used. The reason of this is because the porous resin particle is easy to produce, and the slight gap for producing discharge within the nip between the charging member and the electrophotographic photosensitive member can be stably kept under various environments when the protrusions are formed in the surface of the charging member.

The resin particles can be used singly or in combinations of two or more. The resin particle may be subject to a surface treatment, modification, introduction of a functional group or a molecule chain, coating, and the like. The content of the resin particle in the surface layer is preferably 2 parts by mass or more and 100 parts by mass or less, and more preferably 5 parts by mass or more and 80 parts by mass or less based on 100 parts by mass of the binder resin. At a content within this range, the discharge within the nip can be produced more stably.

The volume average particle size of the resin particle is particularly preferably 10 μm or more and 50 μm or less. At a volume average particle size within this range, the discharge within the nip can be produced more stably.

The porosity in the resin particle included in the surface layer of the charging member needs to be controlled. For this reason, use of a porous resin particle (hereinafter referred to as a "porous particle") as the raw material for the resin particle included in the surface layer is preferable. Furthermore, a porous particle having a porosity in the inner layer portion of the resin particle larger than the porosity in the outer layer portion and a pore size in the outer layer portion larger than the pore size in the inner layer portion is more preferably used. As described later, use of such a porous particle can easily control the porosity in the resin particle that forms the protrusion in the surface of the charging member. In the present invention, the "porous particle" is defined as a particle having numbers of micropores penetrating through the surface of the particle. Hereinafter, the porous particle according to the present invention will be described.

[Porous Particle]

Examples of the material for the porous particle can include acrylic resins, styrene resins, acrylonitrile resins, vinylidene chloride resins, and vinyl chloride resins. These resins can be used alone or in combination of two or more. Monomers that are raw materials for these resins may be copolymerized and used as copolymers. Further, these resins may be used as the main component, and other known resins may be contained when necessary.

The porous particle according to the present invention can be produced by a known production method such as a suspension polymerization method, an interface polymerization method, an interface precipitation method, a liquid drying method, and a method in which a solute or solvent for reducing the solubility of a resin is added to a resin solution to precipitate the resin. For example, in the suspension polymerization method, in the presence of a crosslinkable monomer, a porosifying agent is dissolved in a polymerizable monomer to prepare an oily mixed solution. Using the oily mixed solution, aqueous suspension polymerization is performed in an aqueous medium containing a surfactant and a dispersion stabilizer. After completion of the polymerization, water and the porosifying agent can be removed by washing and drying to obtain a resin particle. A compound having a reactive group reactive with a functional group in the polymerizable monomer, an organic filler or the like can be added. To form porosities inside of the porous particle, the polymerization can be performed in the presence of the crosslinkable monomer.

Examples of the polymerizable monomer include: styrene monomers such as styrene, p-methyl styrene, and p-tert-butyl styrene; and (meth)acrylic acid ester monomers such as methyl acrylate, ethyl acrylate, propyl acrylate, butyl acrylate, 2-ethylhexyl acrylate, lauryl acrylate, methyl methacrylate, ethyl methacrylate, propyl methacrylate, butyl methacrylate, isobutyl methacrylate, tert-butyl methacrylate, benzyl methacrylate, phenyl methacrylate, isobornyl methacrylate, cyclohexyl methacrylate, glycidyl methacrylate, hydrofurfuryl methacrylate, and lauryl methacrylate. These polymerizable monomers are used alone or in combination of two or more. In the present invention, the term "(meth) acrylic" is a concept including both acrylic and methacrylic.

The crosslinkable monomer is not particularly limited as long as the crosslinkable monomer has a plurality of vinyl groups, and examples thereof can include: (meth)acrylic acid ester monomers such as ethylene glycol di(meth)acrylate, diethylene glycol di(meth)acrylate, triethylene glycol di(meth)acrylate, decaethylene glycol di(meth)acrylate, pentadecaethylene glycol di(meth)acrylate, pentacontahectaethylene glycol di(meth)acrylate, 1,3-butylene glycol di(meth) acrylate, 1,4-butanediol di(meth)acrylate, 1,6-hexanediol di(meth)acrylate, glycerol di(meth)acrylate, allyl methacrylate, trimethylolpropane tri(meth)acrylate, pentaerythritol tetra(meth)acrylate, phthalic acid diethylene glycol di(meth) acrylate, caprolactone-modified dipentaerythritol hexa (meth)acrylate, caprolactone-modified hydroxy pivalic acid ester, neopentyl glycol diacrylate, polyester acrylate, and urethane acrylate; divinylbenzene, divinylnaphthalene, and derivatives thereof. These can be used alone or in combination of two or more.

The crosslinkable monomer can be used such that the content in the monomer is 5% by mass or more and 90% by mass or less. At a content within this range, the porosities can be surely formed inside of the porous particle.

As the porosifying agent, a non-polymerizable solvent, a mixture of a linear polymer dissolved in a mixture of polymerizable monomers and a non-polymerizable solvent, and a cellulose resin can be used. Examples of the non-polymerizable solvent can include: toluene, benzene, ethyl acetate, butyl acetate, normal hexane, normal octane, and normal dodecane. The cellulose resin is not particularly limited, and examples thereof can include ethyl cellulose. These porosifying agents can be used alone or in combination of two or more. The amount of the porosifying agent to be added can be properly set according to the purpose of use. The porosifying agent can be used in the range of 20 parts by mass to 90 parts by mass in 100 parts by mass of an oil phase including the polymerizable monomer, the crosslinkable monomer, and the porosifying agent. At the amount within this range, the porous particle is prevented from being fragile, and a gap is easily formed in the nip between the charging member and the electrophotographic photosensitive member.

The polymerization initiator is not particularly limited, and those soluble in the polymerizable monomer can be used. Known peroxide initiators and azo initiators can be used, and examples thereof can include: 2,2'-azobisisobutyronitrile, 1,1'-azobiscyclohexane-1-carbonitrile, 2,2'-azobis-4-methoxy-2,4-dimethylvaleronitrile, and 2,2'-azobis-2,4-dimethylvaleronitrile.

Examples of the surfactant can include: anionic surfactants such as sodium lauryl sulfate, polyoxyethylene (polymerization degree: 1 to 100) sodium lauryl sulfate, and polyoxyethylene (polymerization degree: 1 to 100) lauryl sulfate triethanolamine; cationic surfactants such as stearyl trimethyl ammonium chloride, stearic acid diethylaminoethylamide lactic acid salt, dilaurylamine hydrochloride, and oleylamine lactic acid salt; nonionic surfactants such as adipic acid diethanol amine condensates, lauryldimethylamine oxides, glycerol monostearate, sorbitan monolaurate, and stearic acid diethylaminoethylamide lactic acid salt; amphoteric surfactants such as palm oil fatty acid amide propyl dimethyl amino acetic acid betaine, lauryl hydroxysulfobetaine, and sodium β-laurylaminopropionate; and high molecular dispersants such as polyvinyl alcohol, starch, and carboxymethylcellulose.

Examples of the dispersion stabilizer can include: organic fine particles such as polystyrene fine particles, polymethyl methacrylate fine particles, polyacrylic acid fine particles, and polyepoxide fine particles; silica such as colloidal silica; calcium carbonate, calcium phosphate, aluminum hydroxide, barium carbonate, and magnesium hydroxide.

Among the polymerization methods, particularly a specific example of the suspension polymerization method will be described below. The suspension polymerization can be performed under a sealing condition using a pressure-resistant container. Prior to the polymerization, the raw material component may be suspended with a dispersing machine or the like, the suspension may be placed in a pressure-resistant container and suspension polymerized; or the reaction solution may be suspended in a pressure-resistant container. The polymerization temperature is more preferably 50° C. to 120° C. The polymerization may be performed under atmospheric pressure. To prevent the porosifying agent from becoming gaseous, the polymerization can be performed under increased pressure (under a pressure atmospheric pressure plus 0.1 to 1 MPa). After the polymerization is completed, solid liquid separation, washing and the like may be performed by centrifugation, filtering or the like. After solid liquid separation and washing, the obtained product may be dried or crushed at a temperature equal to or less than the softening temperature of the resin that forms the resin particle. Drying and crushing can be performed by a known method, and an air dryer, a fair wind dryer, and a Nauta Mixer can be used. Drying and crushing can be performed at the same time with a crusher dryer or the like. The surfactant and the dispersion stabilizer can be removed by repeating washing and filtering or the like after production.

The particle diameter of the porous particle can be adjusted according to the mixing conditions for the oily mixed solution including the polymerizable monomer and the porosifying agent and the aqueous medium containing the surfactant and the dispersion stabilizer, the amount of the dispersion stabilizer or the like to be added, and the stirring and dispersing conditions. If the amount of the dispersion stabilizer to be added is increased, the average particle size can be decreased. In the stirring and dispersing conditions, if the stirring rate is increased, the average particle size of the porous particle can be decreased. The porous particle according to the present invention preferably has a volume average particle size in the range of 5 to 60 μm. Furthermore, the volume average particle size is more preferably in the range of 10 to 50 μm. At a volume average particle size within this range, the discharge within the nip can be generated more stably.

The micropore diameter of the porous particle can be adjusted according to the amount of the crosslinkable monomer to be added, and the kind and amount of the porosifying agent to be added. The size of micropore increases if the amount of the porosifying agent to be added is increased or the amount of the crosslinkable monomer to be added is decreased. When the size of micropore is further increased, cellulose resin can be used as the porosifying agent.

The micropore diameter of the porous particle is preferably 10 to 500 nm, and within the range of 20% or less based on the average particle size of the resin particle. Furthermore, the micropore diameter is more preferably 20 to 200 nm, and within the range of 10% or less based on the average particle size of the resin particle. At an average particle size within this range, the gaps are easy to form in the nip between the charging member and the electrophotographic photosensitive member, and stable discharge within the nip can be performed.

If two porosifying agents are used, particularly two porosifying agents having different solubility parameters (hereinafter referred to as an "SP value") are used, a porous particle having a porosity in the outer layer portion of the particle larger than the porosity in the inner layer portion of the particle and a pore size in the outer layer portion thereof larger than the pore size in the inner layer portion thereof can be produced.

As a specific example, an example in which normal hexane and ethyl acetate are used as the porosifying agents will be described below. When the two porosifying agents are used and the oily mixed solution of the polymerizable monomer and the porosifying agents is added to an aqueous medium, a large amount of the ethyl acetate having an SP value close to that of water exists on the aqueous medium side, namely, in the outer layer portions of suspended droplets. In contrast, a larger amount of the normal hexane exists in the inner layer portions of the droplets. The ethyl acetate existing in the outer layer portions of the droplets has an SP value close to that of water, and therefore water is dissolved in the ethyl acetate in a certain degree. In this case, the solubility of the porosifying agent in the polymerizable monomer is lower in the outer layer portions of the droplets than in the inner layer portions of the droplets. As a result, the polymerizable monomer is separated from the porosifying agents more easily than in the inner layer portions. Namely, the porosifying agent is more likely to exist as a larger bulk in the outer layer portions of the droplets than in the inner layer portions. Thus, a porous particle having a porosity in the outer layer portion of the particle larger than the porosity in the inner layer portion of the particle and a pore size in the outer layer portion thereof larger than the pore size in the inner layer portion thereof can be produced, when the polymerization reaction and a post treatment are performed in the state where the porosifying agents are controlled to exist in the inner layer portions of the droplets differently from in the outer layer portions of the droplets.

Accordingly, if one of the two porosifying agents is the porosifying agent having an SP value close to that of water as the medium, the pore diameter in the outer layer portion of the porous particle and the porosity can be increased. Examples of preferable porosifying agents used in the above method can include ethyl acetate, methyl acetate, propyl acetate, isopropyl acetate, butyl acetate, acetone, and methyl ethyl ketone. Additionally, another porosifying agent having high polymerizable monomer solubility and an SP value significantly different from that of water is used. Thereby, the pore size in the inner layer portion of the porous particle can be reduced and the porosity can be reduced. As porosifying agents used in the above method, normal hexane, normal octane, and normal dodecane can be used.

In the present invention, for the porosity to intensively exist in the portion close to the vertex of the protrusion in the surface layer of the charging member, the porous particle having a porosity in the outer layer portion of the particle larger than the porosity in the inner layer portion of the particle and a pore size in the outer layer portion thereof larger than the pore size in the inner can be used. From this viewpoint, the amount of the porosifying agent having an SP value close to that of water is preferably 30 parts by mass or less based on 100 parts by mass of all the porosifying agents. The amount is more preferably within the range of 15 to 25 parts by mass.

Figure 4:
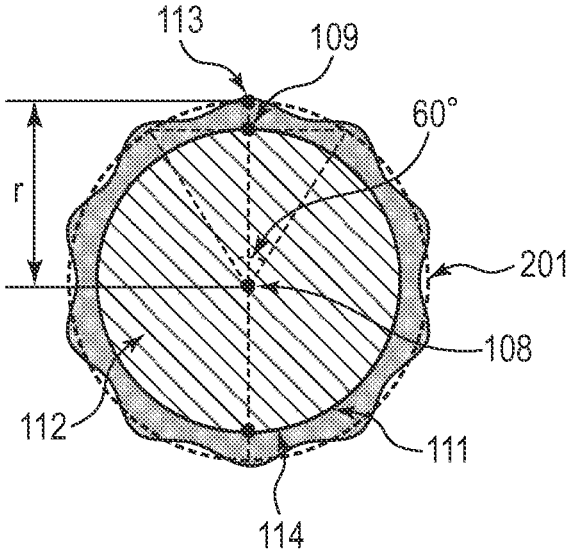
FIG. 4 is a schematic view illustrating a cross sectional image of a resin particle according to the present invention.

The porous particle having a porosity in the outer layer portion of the particle larger than the porosity in the inner layer portion of the particle and a pore size in the outer layer portion thereof larger than the pore size in the inner layer portion thereof, which is used to control the porosity in the present invention, will be described with reference to FIG. 4. First, assuming that a porous particle 201 is a solid particle, its particle radius r and particle center 108 are calculated. Then, a position 109 shifted by $(\sqrt{3})/2$ times the length of the particle radius r from the center 108 toward the vertex side of the protrusion, for example, is calculated. One hundred points disposed uniformly on the outer periphery of the particle are calculated in the same manner as in the case of the point 109, and a virtual line 114 connecting these points (positions) by a straight line is calculated. The inner layer portion is defined as a region on the particle center 108 side with respect to the virtual line 114, namely, a region 112 (diagonally shaded area), and the outer layer portion is defined as a region on the outer side of the position 109 shifted by $(\sqrt{3})/2$ times the length of the particle radius r, namely, a region 111. The methods for measuring parameters will be described later.

In the particle, the porosity in the inner layer portion can be 5% by volume or more and 35% by volume or less, and the mean pore size in the inner layer portion can be 10 nm or more and 45 nm or less. The porosity in the outer layer portion can be 10% by volume or more and 55% by volume or less, and the mean pore size in the outer layer portion can be 30 nm or more and 200 nm or less. At porosity and mean pore sizes within these ranges, the porosity $V_{11}$ in the "vertex side region of the protrusion" of the resin particle that forms a protrusion in the surface layer of the charging member is more easily controlled.

[Conductive Particle]

To develop conductivity, the electro-conductive surface layer according to the present invention contains a known conductive particle. Examples of the electro-conductive particle include: metallic fine particles and fibers of aluminum, palladium, iron, copper, and silver; metal oxides such as titanium oxide, tin oxide, and zinc oxide; composite particles obtained by surface treating the surfaces of the metallic fine particles, fibers, and metal oxides by electrolysis processing, spray coating, or mixing and shaking; and carbon black and carbon fine particles.

Examples of carbon black can include black furnace black, thermal black, acetylene black, and ketjen black.

Examples of furnace black include: SAF-HS, SAF, ISAF-HS, ISAF, ISAF-LS, I-ISAF-HS, HAF-HS, HAF, HAF-LS, T-HS, T-NS, MAF, FEF, GPF, SRF-HS-HM, SRF-LM, ECF, and FEF-HS. Examples of thermal black include FT and MT. Examples of carbon fine particles can include PAN (polyacrylonitrile) carbon particles and pitch carbon particles.

These conductive particles listed can be used singly or in combinations of two or more. The content of the electro-conductive particle in the electro-conductive surface layer is in the range of 2 to 200 parts by mass, and preferably 5 to 100 parts by mass base on 100 parts by mass of the binder resin.

The electro-conductive particle may have a surface treated. As the surface treatment agent, organic silicon compounds such as alkoxysilane, fluoroalkylsilane, and polysiloxane; a variety of coupling agents such as silane coupling agents, titanate coupling agents, aluminate coupling agents, and zirconate coupling agents; oligomers or high molecular compounds can be used. These may be used singly or in combination of two or more. The surface treatment agent is preferably organic silicon compounds such as alkoxysilane and polysiloxane, and a variety of coupling agents such as silane coupling agents, titanate coupling agents, aluminate coupling agents, or zirconate coupling agents, and more preferably organic silicon compounds.

To avoid any substantial influence on the surface of the charging member roughness, the electro-conductive particle preferably has an average particle size of 5 nm or more and 300 nm or less, and particularly 10 nm or more and 100 nm or less. The average particle size of the electro-conductive particle is calculated as follows. Namely, a transmission electron microscope (TEM) is used, and the magnification is adjusted so as to observe at least 100 conductive particles not aggregated in the field. The area-equivalent diameters of the 100 conductive particles not aggregated in the field are determined. The arithmetic mean value of the area-equivalent diameters of the 100 conductive particles is rounded to the nearest whole number, and the thus-determined value is defined as the average particle size of the electro-conductive particle.

[Method of Forming Surface Layer]

Examples of the method of forming the surface layer include a method wherein a layer of an electro-conductive resin composition is formed on an electro-conductive substrate by a coating method such as electrostatic spray coating, dipping coating, or roll coating, and the layer is cured by drying, heating, crosslinking, or the like. Another example of the method of forming the surface layer is a method wherein an electro-conductive resin composition is formed into a film having a predetermined thickness, the film is cured to produce a sheet-like or tubular layer, and the layer is bonded or coated to an electro-conductive substrate. Alternatively, an electro-conductive resin composition can be placed in a mold in which an electro-conductive substrate is disposed, and cured to form a surface layer. Among these, a method wherein the surface layer is formed by electrostatic spray coating, dipping coating, or roll coating is preferable because the porosity in the protrusion in the surface layer of the charging member is controlled to form a uniform surface layer.

When these coating methods are used, a "coating solution for a surface layer" prepared by dispersing the electro-conductive particle and the porous particle in the binder resin can be applied to the surface of the electro-conductive substrate. Furthermore, for easier control of the porosity, a solvent can be used for the coating solution. Particularly, a polar solvent enabling dissolution of the binder resin and having high affinity with the porous particle can be used.

Specifically, examples of the solvent include: ketones such as acetone, methyl ethyl ketone, methyl isobutyl ketone, and cyclohexanone; alcohols such as methanol, ethanol, and isopropanol; amides such as N,N-dimethylformamide and N,N-dimethylacetamide; sulfoxides such as dimethyl sulfoxide; ethers such as tetrahydrofuran, dioxane, and ethylene glycol monomethyl ether; and esters such as methyl acetate, and ethyl acetate.

As the method of dispersing the binder resin, the electro-conductive particle, and the porous particle in the coating solution, a solution dispersing method such as a ball mill, a sand mill, a paint shaker, a DYNO-MILL, and a pearl mill can be used.

As described above, the porous particle having a porosity in the outer layer portion larger than the porosity in the inner layer portion and a pore size in the outer layer portion larger than the pore size in the inner layer portion can be used.

When the surface layer is formed by the above method, the porosity is more easily controlled in the protrusion in the surface of the charging member. The reason will be described below using FIGS. 7A to 7E.

Figure 7A:
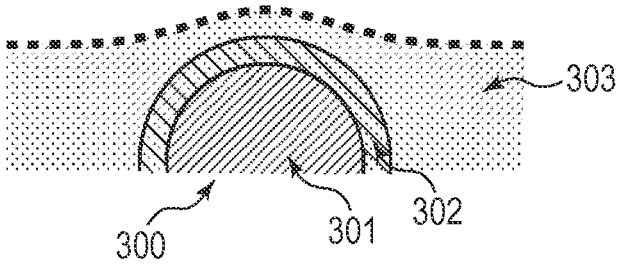
FIG. 7A is a schematic view illustrating a flow of a binder resin and a solvent in production of the charging member according to the present invention immediately after a coating solution for a surface layer is applied.
Figure 7B:
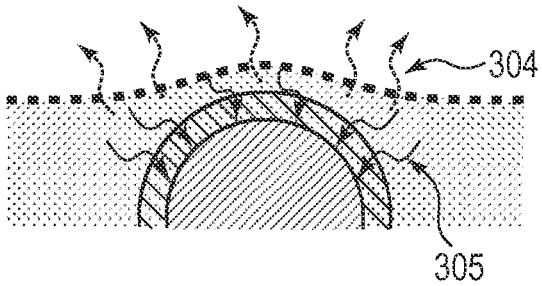
FIG. 7B is a schematic view illustrating a flow of a binder resin and a solvent in production of the charging member according to the present invention immediately after a coating solution for a surface layer is applied.

FIG. 7A is a schematic view showing the state immediately after the coating solution for forming a surface layer is applied to the surface of the electro-conductive substrate by the method above to form a coating 303. The coating 303 contains the solvent, the binder resin, the electro-conductive particle, and a porous particle 300. The porous particle is formed of an inner layer region 301 and an outer layer region 302. The state in FIG. 7A illustrates that in the porous particle, the porosity in the outer layer region is larger than that in the inner layer region, and the pore diameter in the outer layer region is larger than that in the inner layer region. In this state, it is presumed that at least the solvent and the binder resin uniformly permeate through the inside of the pores in the porous particle. Immediately after the coating solution is applied to the surface of the electro-conductive substrate, volatilization of the solvent progresses from the side of the surface of the coating solution. At this time, volatilization of the solvent progresses in the direction of the arrow 304 in FIG. 7B, and the concentration of the binder resin will increase on the side of the surface of the coating 303. Inside of the coating 303, a force acts to keep the concentration of the solvent and that of the binder resin constant, causing the binder resin in the coating to flow in the direction of the arrow 305.

Figure 7C:
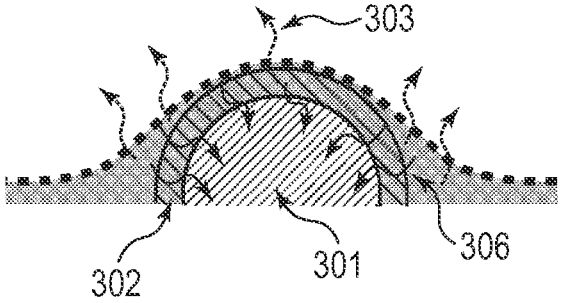
FIG. 7C is a schematic view illustrating a flow of a binder resin and a solvent in production of the charging member according to the present invention immediately after a coating solution for a surface layer is applied.

The inner layer region 301 in the porous particle has a pore diameter smaller than that in the outer layer region 302 and a porosity smaller than that in the outer layer region. For this reason, the moving speeds of the solvent and binder resin in the inner layer region are slower than those of the solvent and binder resin in the outer layer region. Accordingly, while the binder resin moves in the direction of the arrow 305, the difference in the moving speeds of the solvent and the binder resin in the inner layer region of the porous particle and the outer layer region thereof causes a state where the concentration of the binder resin in the outer layer region is higher than the concentration of the binder resin in the inner layer region. FIG. 7C illustrates a state where the concentration of the binder resin in the outer layer region 302 is higher than that in the inner layer region 301.

In the state where the difference in the concentration is produced, a flow 306 of the binder resin occurs to relax the difference in the concentration of the binder resin between the inner layer region of the porous particle and the outer layer region thereof. The solvent is volatilizing in the direction 303 all the time. For this reason, the concentration of the binder resin in the outer layer region is reduced compared to that in the inner layer region of the porous particle. Namely, the state changes to the state shown in FIG. 7D. Under the state shown in FIG. 7D, the coating is dried, cured, crosslinked or the like at a temperature or more of the boiling point of the solvent to be used. Thereby, the solvent left in the outer layer region 302 of the porous particle volatilizes all at once, and finally porosities 307 can be formed in the outer layer region of the porous particle as shown in FIG. 7E.

Figure 7D:
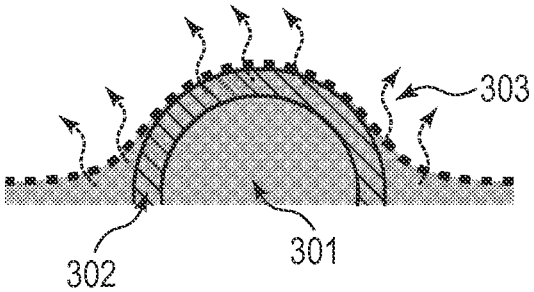
FIG. 7D is a schematic view illustrating a flow of a binder resin and a solvent in production of the charging member according to the present invention immediately after a coating solution for a surface layer is applied.
Figure 7E:
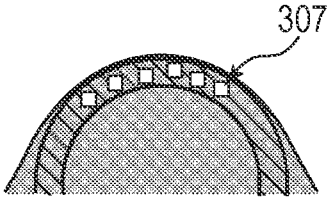
FIG. 7E is a schematic view illustrating a flow of a binder resin and a solvent in production of the charging member according to the present invention immediately after a coating solution for a surface layer is applied.

In the state shown in FIG. 7D, the solvent existing inside of the porosity in the inner layer region does not move to the outer layer portion completely, and part thereof may remain in the inner layer portion. In this case, the porosity is formed in the inner layer portion by volatilization of the solvent. When a micropore not penetrating through the surface of the porous particle exists in the inner layer portion of the porous particle, the binder resin does not permeate into the micropore and the state where the porosity is formed is kept. Use of the method above enables ensuring control of the porosity in the protrusion in the charging member. For easier control of the porosity, more preferably, the porosity and ratio of the pore diameters in the inner layer region and outer layer region of the porous particle are controlled. Namely, the porosity in the outer layer portion can be 1.5 times or more and 3 times or less the porosity in the inner layer portion, and the pore diameter in the outer layer portion can be 2 times or more and 10 times or less the pore diameter in the inner layer portion. To control the flow of the solvent, the polar solvent having high affinity with the porous particle can be used. Among these solvents, use of ketones and esters are more preferable.

In the drying, curing, or crosslinking step after the coating solution for a surface layer is applied, the temperature and time can be controlled. By controlling the temperature and time, the moving speeds of the solvent and the binder resin described above can be controlled. Specifically, the step after formation of the coating can include three or more steps. The state of the step after formation of the coating including three or more steps will be described in detail.

In a first step, after formation of the coating, the coating can be left as it is under a room temperature atmosphere for 15 minutes or more and one hour or less. Thereby, it is easy to form the state illustrated in FIG. 7B mildly.

In a second step, the coating can be left as it is for 15 minutes or more and one hour or less at a temperature of room temperature or more and the boiling point or less of the solvent to be used. Depending somewhat on the kind of solvents to be used, specifically, the temperature is more preferably controlled to be 40° C. or more and 100° C. or less, and the coating is left as it is for 30 minutes or more and 50 minutes or less. The second step can accelerate the volatilizing speed of the solvent in the FIG. 7C and control to increase the concentration of the binder resin in the inner layer region 301 of the porous particle more easily.

A third step is a step of drying, curing, or crosslinking the coating at a temperature of the boiling point or more of the solvent. At this time, the temperature in the third step can be rapidly raised from that in the second step and controlled. Thereby, the pores are easily formed in the vicinity of the protrusion vertex. Specifically, the temperature is not controlled in the same drying furnace, but can be controlled using different drying furnaces or different areas of the drying furnace in the second step and the third step. The workpiece can be moved from apparatus to apparatus or from area to area in as short a time as possible.

Namely, examples of the method of forming the surface layer in the charging member according to the present invention include a method including the following steps (1) and (2):

(1) a step of forming a coating of the coating solution for a surface layer containing the binder resin, the solvent, the electro-conductive particle, and the porous particle on the surface of the electro-conductive substrate or the surface of another layer formed on the electro-conductive substrate, and (2) a step of volatilizing the solvent in the coating to form the surface layer.

The step (2) is a process to volatilize the solvent in the coating, and can include the following steps (3) and (4):

(3) a step of replacing the solvent permeating through the pores in the porous particle by the binder resin, and (4) a step of drying the coating at a temperature of the boiling point or more of the solvent.

The porous particle can be a porous resin particle in which the porosity in the outer layer portion is larger than that in the inner layer portion and the pore diameter in the outer layer portion is larger than that in the inner layer portion.

The pore size of the "resin particle" in the "vertex side region of the protrusion" in the surface layer of the charging member obtained by the above production method is often larger than the mean pore size of the "porous particle" as the raw material in the outer layer portion. The reason is presumed: among the porosities existing in the outer layer portion of the porous particle, a relatively large porosity is easy to form the porosity by volatilization of the solvent.

The pore size $R_{11}$ in the "vertex side region of the protrusion" of the resin particle in the surface layer is preferably within the range of 30 nm or more and 200 nm or less as the mean pore size. The pore size $R_{11}$ is more preferably 60 nm or more and 150 nm or less. At a pore size $R_{11}$ within this range, the discharge within the nip can be kept more easily and scratches to be produced in the electrophotographic photosensitive member can be suppressed more easily.

One specific example of the method of forming the surface layer will be described below.

First, dispersion components other than the porous particle (such as the electro-conductive particle and the solvent) with glass beads having a diameter of 0.8 mm are mixed with the binder resin, and the mixture is dispersed over 5 to 60 hours using a paint shaker dispersing machine. Next, the porous particle is added, and the mixture is further dispersed. The dispersion time can be 2 minutes or more and 30 minutes or less. Here, conditions for preventing the porous particle from being crushed are needed. Subsequently, the viscosity of the dispersion solution is adjusted to be 3 to 30 mPa, and more preferably 3 to 20 mPa. Thus, a coating solution for a surface layer is prepared.

Next, a coating of the coating solution for a surface layer is formed on the electro-conductive substrate by dipping or the like. The thickness of the coating is preferably adjusted such that the film thickness after drying is 0.5 to 50 μm, more preferably 1 to 20 μm, and particularly preferably 1 to 10 μm.

The film thickness of the surface layer can be measured by cutting out the cross section of the charging member with a sharp knife and observing the cross section with an optical microscope or an electron microscope. Any three points in the longitudinal direction of the charging member and three points in the circumferential direction thereof, nine points in total are measured, and the average value is defined as the film thickness. When the film thickness is thick, namely, the coating solution has a small amount of the solvent, the solvent volatilizing rate may reduce, causing difficulties in control of the porosity. Accordingly, the concentration of the solid content in the coating solution is preferably relatively small. The proportion of the solvent in the coating solution is preferably 40% by mass or more, more preferably 50% by mass or more, and particularly preferably 60% by mass or more.

The specific gravity of the coating solution is adjusted to be preferably 0.8000 or more and 1.200 or less, and more preferably 0.8500 or more and 1.000 or less. At a specific gravity within this range, it is easy to control permeation of the binder resin into the porosity in the inner layer portion of the porous particle and into the porosity in the outer layer portion thereof at desired rates.

[Other Materials]

The electro-conductive surface layer according to the present invention may contain an insulation particle in addition to the electro-conductive fine particle. Examples of the material that forms the insulation particle include: zinc oxide, tin oxide, indium oxide, titanium oxides (such as titanium dioxide and titanium monooxide), iron oxide, silica, alumina, magnesium oxide, zirconium oxide, strontium titanate, calcium titanate, magnesium titanate, barium titanate, calcium zirconate, barium sulfate, molybdenum disulfide, calcium carbonate, magnesium carbonate, dolomite, talc, kaolin clay, mica, aluminum hydroxide, magnesium hydroxide, zeolite, wollastonite, diatomite, glass beads, bentonite, montmorillonite, hollow glass balls, organic metal compounds, and organic metal salts. Iron oxides such as ferrite, magnetite, and hematite and activated carbon can also be used.

To improve releasing properties, the electro-conductive surface layer may further contain a mold release agent. If the electro-conductive surface layer contains a mold release agent, dirt can be prevented from adhering to the surface of the charging member, improving the durability of the charging member. When the mold release agent is a liquid, the mold release agent also acts as a leveling agent when the electro-conductive surface layer is formed. The electro-conductive surface layer may be surface treated. Examples of the surface treatment can include surface machining with UV or an electron beam, and surface modification in which a compound is applied to the surface and/or the surface is impregnated with the compound.

[Volume Resistivity]

The volume resistivity of the electro-conductive surface layer according to the present invention can be $1\times10^{2}$ Ω·cm or more and $1\times10^{16}$ Ω·cm or less in an environment of a temperature of 23° C. and a relative humidity of 50%. At a volume resistivity within this range, the electrophotographic photosensitive member is easier to charge properly by discharging.

The volume resistivity of the electro-conductive surface layer is determined as follows. First, from the charging member, the electro-conductive surface layer is cut out into a strip having a length of 5 mm, a width of 5 mm, and a thickness of 1 mm. A metal is deposited onto both surfaces of the obtained test piece to produce a sample for measurement. When the electro-conductive surface layer cannot be cut into a thin film, the coating solution for a surface layer is applied onto an aluminum sheet to form a coating, and a metal is deposited onto the coating to produce a sample for measurement. A voltage of 200 V is applied to the obtained sample for measurement using a microammeter (trade name: ADVANTEST R8340A ULTRA HIGH RESISTANCE METER, made by Advantest Corporation). Then, the current after 30 seconds is measured. The volume resistivity is determined by calculation from the thickness of the film and the area of the electrode. The volume resistivity of the electro-conductive surface layer can be adjusted by the electro-conductive particle described above.

The electro-conductive particle has an average particle size of more preferably 0.01 to 0.9 μm, and still more preferably 0.01 to 0.5 μm. At an average particle size within this range, the volume resistivity of the surface layer is easily controlled.

<Conductive Elastic Layer>

In the charging member according to the present invention, an electro-conductive elastic layer may be formed between the electro-conductive substrate and the electro-conductive surface layer. As the binder material used for the electro-conductive elastic layer, a known rubber or resin can be used. From the viewpoint of ensuring a sufficient nip between the charging member and the photosensitive member, the binder material preferably has relatively low elasticity. Use of rubber is more preferable. Examples of rubber can include natural rubber, vulcanized natural rubber, and synthetic rubber.

Examples of the synthetic rubber include: ethylene propylene rubber, styrene butadiene rubber (SBR), silicone rubber, urethane rubber, isoprene rubber (IR), butyl rubber, acrylonitrile butadiene rubber (NBR), chloroprene rubber (CR), acrylic rubber, epichlorohydrin rubber, and fluorine rubber.

The electro-conductive elastic layer preferably has a volume resistivity of $10^2$ Ω·cm or more and $10^{10}$ Ω·cm or less under an environment of a temperature of 23° C. and a relative humidity of 50%. The volume resistivity of the electro-conductive elastic layer can be adjusted by adding the electro-conductive fine particle and an ionic conductive agent to the binder material properly. Examples of the ionic conductive agent include: inorganic ion substances such as lithium perchlorate, sodium perchlorate, and calcium perchlorate; cationic surfactants such as lauryltrimethylammonium chloride, stearyltrimethylammonium chloride, octadecyltrimethylammonium chloride, dodecyltrimethylammonium chloride, hexadecyltrimethylammonium chloride, trioctylpropylammonium bromide, and modified aliphatic dimethylethylammonium ethosulfate; amphoteric ion surfactants such as lauryl betaine, stearyl betaine, and dimethylalkyllauryl betaine; quaternary ammonium salts such as tetraethylammonium perchlorate, tetrabutylammonium perchlorate, and trimethyloctadecylammonium perchlorate; and organic acid lithium salts such as lithium trifluoromethanesulfonate. These can be used singly or in combinations of two or more.

When the binder material is a polar rubber, particularly ammonium salts are preferably used. To adjust hardness or the like, the electro-conductive elastic layer may contain additives such as a softening oil and a plasticizer, and the insulation particle in addition to the electro-conductive fine particle. The electro-conductive elastic layer can be provided by bonding the electro-conductive elastic layer to the electro-conductive substrate or the electro-conductive surface layer with an adhesive. An electro-conductive adhesive can be used.

The volume resistivity of the electro-conductive elastic layer can be measured as follow. The material used for the electro-conductive elastic layer is molded into a sheet having a thickness of 1 mm, and a metal is deposited onto both surfaces of the sheet to produce a sample for measuring the volume resistivity. Using the sample, volume resistivity of the electro-conductive elastic layer can be measured in the same manner as in the method of measuring the volume resistivity of the surface layer.

<Charging Member>

The charging member according to the present invention may have the electro-conductive substrate and the electro-conductive surface layer, and may have any shape of a roller shape, a flat plate shape and the like. Hereinafter, the charging member will be described in detail using a charging roller as one example of the charging member.

With an adhesive, the electro-conductive substrate may be bonded to the layer disposed immediately above the electro-conductive substrate. In this case, the adhesive can be one having conductivity. To give conductivity, the adhesive can contain a known conductive agent. Examples of the binder for the adhesive include thermosetting resins and thermoplastic resins. Known urethane resins, acrylic resins, polyester resins, polyether resins, and epoxy resins can be used. The electro-conductive agent for giving conductivity to the adhesive can be properly selected from the electro-conductive particles and the ionic conductive agents. These selected conductive agents can be used alone or in combination of two or more.

To charge the electrophotographic photosensitive member well, more preferably, the charging roller according to the present invention usually has an electric resistance value of $1\times10^3$Ω or more and $1\times10^{10}$Ω or less in an environment of a temperature of 23° C. and a relative humidity of 50%.

Figure 8:
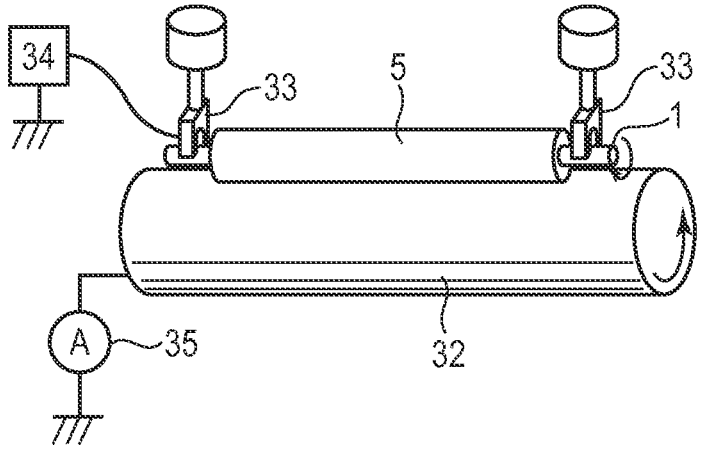
FIG. 8 is a schematic view illustrating an apparatus used for measuring the electric resistance value of the charging roller.

As one example, a method of measuring the electric resistance value of the charging roller is shown in FIG. 8. Both ends of the electro-conductive substrate 1 are brought into parallel contact with a cylindrical metal 32 having the same curvature as that of the electrophotographic photosensitive member by bearings 33 to which loads are applied. In this state, while the cylindrical metal 32 is rotated by a motor (not illustrated) to rotate the charging roller 5 contacting the cylindrical metal following the rotation of the cylindrical metal, a DC voltage of −200 V is applied from a stabilized power supply 34. The current flowing at this time is measured with an ammeter 35, and the electric resistance value of the charging roller is calculated. In the present invention, each of the loads is 4.9 N, and the metal cylinder has a diameter of 30 mm and rotates at a circumferential speed of 45 mm/sec.

From the viewpoint of a uniform nip width in the longitudinal direction with respect to the electrophotographic photosensitive member, the charging roller according to the present invention can have a crown shape in which the central portion in the longitudinal direction of the charging member is the thickest and the thickness of the charging roller reduces toward the ends in the longitudinal direction. For the crown amount, the difference between the outer diameter of the central portion and the outer diameters 90 mm spaced from the central portion toward the ends (average value) can be 30 μm or more and 200 μm or less.

The hardness of the surface of the charging member is preferably 90° or less, and more preferably 40° or more and 80° or less as a value measured with a microdurometer (MD-1 Type A). At a hardness within this range, the contact state of the charging member and the electrophotographic photosensitive member is easily stabilized, and discharge within the nip can be more stably performed.

The "microhardness (MD-1 Type A)" is a hardness of the charging member measured using an ASKER rubber microdurometer MD-1 Type A (trade name, made by Kobunshi Keiki Co., Ltd.). Specifically, the hardness is a value when the charging member left in an environment of normal temperature and normal humidity (temperature: 23° C., relative humidity: 55%) for 12 hours or more is measured with the microdurometer in a peak hold mode at 10 N.

The surface of the charging member preferably has a ten-point height of irregularities (Rzjis) of 8 μm or more and 100 μm or less, and more preferably 12 μm or more and 60 μm or less. The average interval between the concavity and the protrusion (RSm) of the surface is 20 μm or more and 300 μm or less, and more preferably 50 μm or more and 200 μm or less. At Rzjis and Rsm within these ranges, a gap is easily formed in the nip between the charging member and the electrophotographic photosensitive member, and discharge within the nip can be stably performed.

The ten-point height of irregularities and the average interval between the concavity and the protrusion are measured according to the specification of surface roughness specified in JIS B 0601-1994 using a surface roughness measuring apparatus "SE-3500" (trade name, made by Kosaka Laboratory Ltd.). Any six places in the charging member are measured for the ten-point height of irregularities, and the average value thereof is defined as the ten-point height of irregularities. The average interval between the concavity and the protrusion is determined as follows: ten intervals between the concavity and the protrusion is measured at the any six places to determine the average value, and the average value of the "average values at the six places" is calculated. In the measurement, a cut-off value is 0.8 mm, and an evaluation length is 8 mm.

<Process Cartridge>

Figure 10:
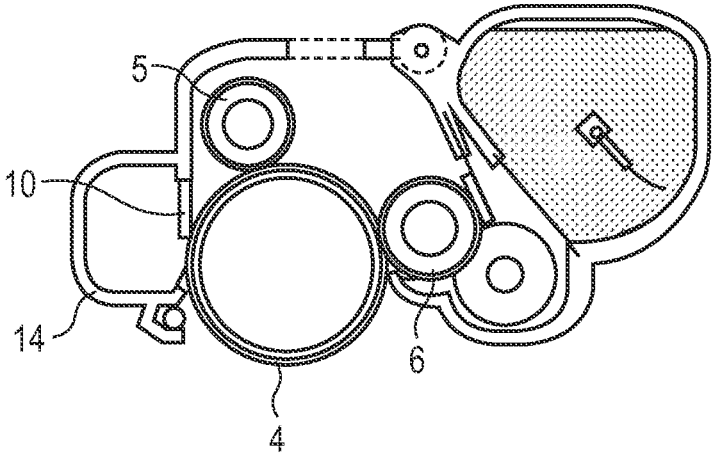
FIG. 10 is a schematic view illustrating a cross section of one example of a process cartridge according to the present invention.

The process cartridge according to the present invention is a process cartridge detachably mountable on the main body of the electrophotographic apparatus wherein the charging member according to the present invention is integrated with at least the member to be charged. One example of a schematic configuration of the process cartridge including the charging member according to the present invention is shown in FIG. 10. The process cartridge is detachably mountable on the main body of the electrophotographic apparatus wherein an electrophotographic photosensitive member 4, a charging apparatus, a developing apparatus having a developing roller 6, and a cleaning apparatus having a blade type cleaning member 10 and a recovering container 14 are integrated.

<Electrophotographic Apparatus>

Figure 9:
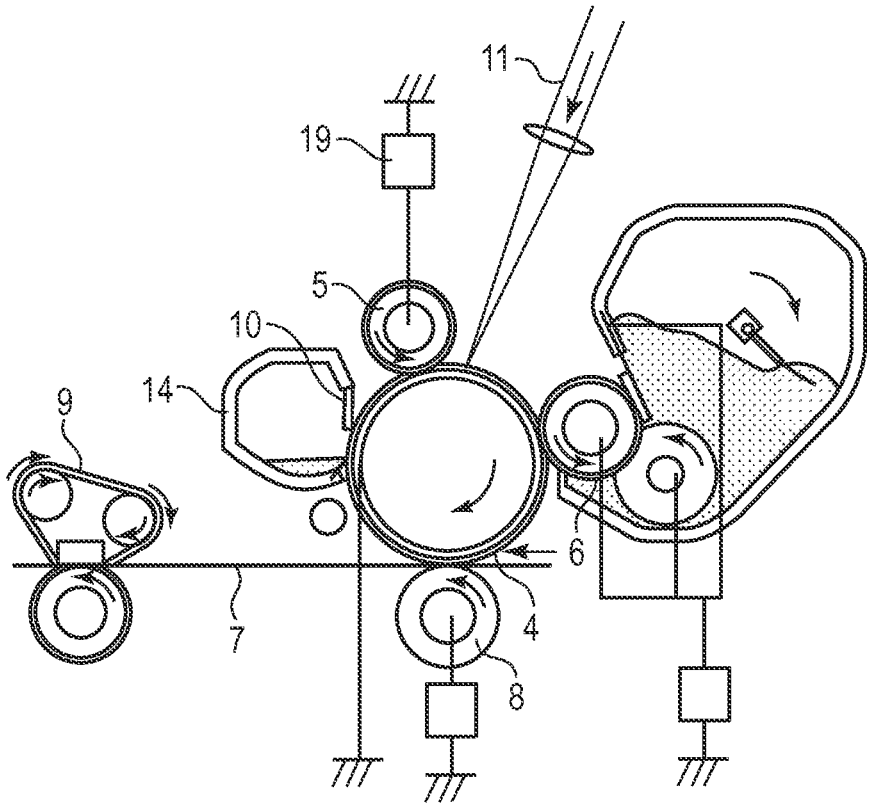
FIG. 9 is a schematic view illustrating a cross section of one example of an electrophotographic apparatus according to the present invention.

The electrophotographic apparatus according to the present invention is an electrophotographic apparatus including the charging member and a member to be charged. One example of a schematic configuration of the electrophotographic apparatus including the charging member according to the present invention is shown in FIG. 9. The electrophotographic apparatus includes an electrophotographic photosensitive member, a charging apparatus that charges the electrophotographic photosensitive member, a latent image forming apparatus that performs exposure, a developing apparatus that develops the latent image, a transfer apparatus, a cleaning apparatus that recovers a transferred toner on the electrophotographic photosensitive member, and a fixing apparatus that fixes the toner image, for example.

An electrophotographic photosensitive member 4 is a rotary drum type member having a photosensitive layer on the electro-conductive substrate. The electrophotographic photosensitive member is rotatably driven in the arrow direction at a predetermined circumferential speed (process speed). The charging apparatus includes a contact type charging roller 5 which is brought into contact with the electrophotographic photosensitive member 4 at a predetermined pressure to be contact disposed. The charging roller 5 rotates following the rotation of the electrophotographic photosensitive member. A predetermined DC voltage is applied from a power supply for charging 19 to charge the electrophotographic photosensitive member to a predetermined potential.

For a latent image forming apparatus 11 for forming an electrostatic latent image on the electrophotographic photosensitive member 4, an exposure apparatus such as a laser beam scanner is used. An electrostatic latent image is formed by exposing a uniformly charged electrophotographic photosensitive member in correspondence with image information. The developing apparatus includes a developing sleeve or developing roller 6 disposed close to or in contact with the electrophotographic photosensitive member 4. Using an electrostatically treated toner to have the same polarity as the charging polarity of the electrophotographic photosensitive member, an electrostatic latent image is developed by reversal development to form a toner image.

The transfer apparatus includes a contact type transfer roller 8. The toner image is transferred from the electrophotographic photosensitive member onto a transfer material 7 such as normal paper. The transfer material is conveyed by a sheet feeding system having a conveying member. The cleaning apparatus includes a blade type cleaning member 10 and a recovering container 14. After transfer, the cleaning apparatus dynamically scrapes off the transfer remaining toner left on the electrophotographic photosensitive member and recovers the toner. Here, the cleaning apparatus can be eliminated by adopting a simultaneous developing and cleaning method in which the transfer remaining toner is recovered with the developing apparatus. The fixing apparatus 9 is composed of a heated roller or the like. The fixing apparatus 9 fixes the transferred toner image on the transfer material 7, and discharges the transfer material to the outside of the apparatus.

EXAMPLES

Hereinafter, the present invention will be described more in details by way of Examples. First, before Examples, methods of measuring a variety of parameters in the present invention, Production Examples A1 to A34 of the porous particle and others, Production Example B1 of the electro-conductive particle, and Production Example B2 of the insulation particle will be described. In respective particles below, the "average particle size" means the "volume average particle size" unless otherwise specified.

<Methods of Measuring a Variety of Parameters>

[1-1] Observation of the Cross Section of the Resin Particle as the Raw Material (1) Observation of Resin Particles A1 to A24 and A27 as "Porous Particle"

First, the porous particle is embedded using a photocurable resin such as visible light-curable embedding resins (trade name: D-800, made by Nisshin EM Corporation, or trade name: Epok812 Set, made by Okenshoji Co., Ltd. Next, trimming is performed using an ultramicrotome (trade name: LEICA EM UCT, made by Leica) on which a diamond knife (trade name: DiATOMECRYO DRY, made by Diatome AG) is mounted, and a cryosystem (trade name: LEICA EM FCS, made by Leica). Thereafter, the center of the porous particle (to include a portion in the vicinity of the center of gravity 107 illustrated in FIG. 5) is cut out to form a section having a thickness of 100 nm. Subsequently, the embedding resin is dyed with any one of dyeing agents selected from osmium tetraoxide, ruthenium tetraoxide, and phosphorus tungstate, and a sectional image of the porous particle is photographed with a transmission electron microscope (trade name: H-7100FA, made by Hitachi, Ltd.). This operation is performed on any 100 particles. The embedding resin and the dyeing agent are properly selected according to the material of the porous particle. At this time, a combination enabling the pores in the porous particle to be clearly seen is selected.

(2) Observation of Other Resin Particles A26 and A28 to A32

The sectional image is photographed in the same manner as above except that the piece is not dyed. Any 100 particles are observed similarly.

[1-2] Measurement of Volume Average Particle Size of Resin Particle as Raw Material In the cross sectional image of the particle obtained in [1-1] above, the total area including a region including the porosity portion is calculated. The diameter of a circle having an area equal to the area is determined, and the diameter is defined as the particle size of the particle. The particle sizes of 100 resin particles are calculated, and the average value thereof is defined as the volume average particle size of the resin particle.

[1-3] Measurement of Porosity of Resin Particle as Raw Material

The method of calculating the porosity of the resin particle will be described in detail using FIG. 4. In the cross sectional image of the particle obtained in [1-1] above, the center 108 of the resin particle is calculated from the circle 201 obtained by the method described in [1-2] above, and the circle is superposed on the cross sectional image. A point on the circumference obtained by equally 100 dividing the outer periphery of the circle (such as 113) is calculated. A straight line connecting the point on the circumference to the center of the resin particle is drawn. A position (such as 109) shifted by (√3)/2 times the length of the particle radius r from the center 108 toward the vertex side of the protrusion (for example, the direction from 108 to 113) is calculated. The calculation is performed in all the points on the circumference obtained by dividing the outer periphery of the circle 201 (113-1, 113-2, 113-3, . . . ) by 100, and 100 points corresponding to the position 109 (109-1, 109-2, 109-3, . . . ) are determined. These 100 points are connected by a straight line to draw a closed curve. The inner region 112 thereof is defined as the inner layer region of the resin particle, and the outer region 111 thereof is defined as the outer layer region of the resin particle.

In the inner layer region and the outer layer region in the resin particle, the proportion of the total area Sv of the pore portion to the total area S including the region containing the pore portion (10 Sv/S) is calculated in the sectional image. The average is defined as the porosity (%) of the resin particle.

[1-4] Measurement of the Pore Size of the Resin Particle as Raw Material

In the inner layer region and outer layer region of the resin particle, the each volume of any 10 places in the porosity portion seen in black is calculated. The diameter of a sphere having a volume equal to the volume is determined. This operation is performed on any 10 resin particles, and the average value of the obtained diameters of 100 spheres in total is calculated. The average value thereof is defined as the pore size of the resin particle.

[1-5] Measurement of the "Stereoscopic Particle Shape" of the Resin Particle Contained in the Surface Layer Any protrusion in the surface of the charging member is cut out over a region having a length of 200 μm and a width of 200 μm parallel to the surface of the charging member by 20 nm from the vertex side of protrusion of the charging member using a focused ion beam machining observation apparatus (trade name: FB-2000C, made by Hitachi, Ltd.). An image of the cross section is photographed. The images obtained by photographing the same particle are combined at an interval of 20 nm, and the "stereoscopic particle shape" is calculated. This operation is performed on any 100 places in the surface of the charging member.

[1-6] Measurement of the Volume Average Particle Size of the Resin Particle Contained in the Surface Layer In the "stereoscopic particle shape" obtained by the method described in [1-5], the total volume including the region containing the pores is calculated. This is the volume of the resin particle assuming that the resin particle is a solid particle. Then, the diameter of a sphere having a volume equal to the volume is determined. The average value of the obtained diameters of 100 spheres in total is calculated, and defined as the "volume average particle size" of the resin particle.

Figure 5:
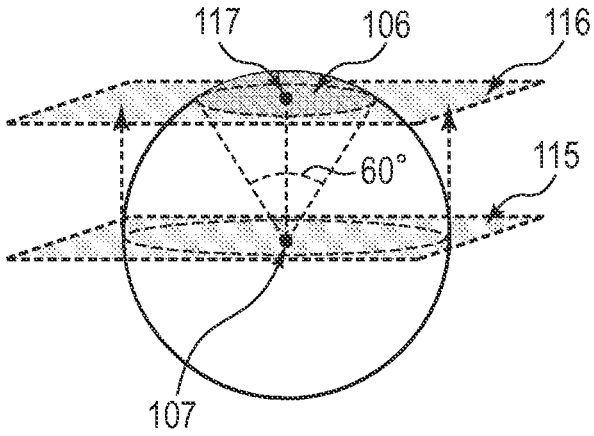
FIG. 5 is a schematic view illustrating a stereoscopic image of the resin particle in the electro-conductive surface layer according to the present invention.

[1-7] Measurement of the Porosity of the Resin Particle Contained in the Surface Layer From the "stereoscopic particle shape" obtained by the method described in [1-5], the "vertex side region of the protrusion" of the solid particle is calculated assuming that the resin particle is the solid particle. FIG. 5 is a diagram schematically showing the resin particle that forms the protrusion in the surface of the charging member. The method of calculating the porosity will be described below using these drawings. First, from the "stereoscopic particle shape," the center of gravity 107 of the resin particle is calculated. A virtual plane 115 being parallel to the surface of the charging member and passing through the center of gravity of the resin particle is created. The virtual plane is translated by a distance of (√3)/2 times length of the radius r of the sphere from the center of gravity of the resin particle to the vertex side of the protrusion. That is, the center of gravity 107 is translated to the position of 117. A region 106 on the vertex side of the protrusion surrounded by a plane 116 formed by parallel translation and the surface of the resin particle is defined as the "vertex side region of the protrusion" of the solid particle when it is assumed that the resin particle is a solid particle.

In the region, from the "stereoscopic particle shape," the total volume of the pore is calculated, and the proportion thereof to the total volume of the region including the pores is calculated. This is defined as the porosity $V_{11}$ of the resin particle in the "vertex side region of the protrusion." From the "stereoscopic particle shape," the total volume of the pore in the entire resin particle is calculated, and the proportion thereof to the total volume of the resin particle including the region containing the pores is calculated. This is defined as the porosity Vt of the entire resin particle.

[1-8] Measurement of the Pore Diameter of the Resin Particle Contained in the Surface Layer In the "vertex side region of the protrusion" of the solid particle when it is assumed that the resin particle is the solid particle, from the "stereoscopic particle shape" obtained above, the largest length and the smallest length of a pore portion are measured in 10 pore portions, and the average value of the largest lengths and that of the smallest lengths are calculated. This operation is performed on any 10 resin particles. The average value of the 100 measurement values obtained in total is calculated, and defined as the pore diameter in the "vertex side region of the protrusion" in the resin particle. At the same time, the pore size in the inner layer region is determined similarly. The mean particle size in the region is calculated by the same method as above, and defined as the pore size in the inner layer region.

2. Production Examples of Porous Particle and the Like

Production Example A1

8.0 parts by mass of tricalcium phosphate was added to 400 parts by mass of deionized water to prepare an aqueous medium. Next, 38.0 parts by mass of methyl methacrylate as the polymerizable monomer, 26.0 parts by mass of ethylene glycol dimethacrylate as the crosslinkable monomer, 34.1 parts by mass of normal hexane as the first porosifying agent, 8.5 parts by mass of ethyl acetate as the second porosifying agent, and 0.3 parts by mass of 2,2'-azobisisobutyronitrile were mixed to prepare an oily mixed solution. The oily mixed solution was dispersed in the aqueous medium at the number of rotation of 2000 rpm with a homomixer. Subsequently, the obtained solution was charged into a polymerization reaction container whose inside was replaced by nitrogen. While the solution was being stirred at 250 rpm, suspension polymerization was performed at 60° C. over 6 hours. Thus, an aqueous suspension containing the porous resin particle, and normal hexane and ethyl acetate was obtained. To the aqueous suspension, 0.4 parts by mass of sodium dodecylbenzenesulfonate was added, and the concentration of sodium dodecylbenzenesulfonate was adjusted to be 0.1% by mass based on water.

The obtained aqueous suspension was distilled to remove normal hexane and ethyl acetate, and the remaining aqueous suspension was repeatedly filtered and washed with water. Then, drying was performed at 80° C. for 5 hours. The product was crushed and classified with a sonic classifier to obtain a resin particle A1 having an average particle size of 30.5 μm. The cross section of the particle was observed by the method above. The resin particle A1 was a "porous particle" having a porosity with a size of approximately 21 nm in the inner layer portion of the particle and a porosity with a size of approximately 87 nm in the outer layer portion thereof.

Production Examples A2 to A24

Resin particles A2 to A24 were obtained in the same manner as in Production Example A1 except that an oily mixed solution of the polymerizable monomer, the crosslinkable monomer, the first porosifying agent, and the second porosifying agent shown in Table 1 was used and the number of rotation of the homomixer was changed as shown in Table 1. These particles were the "porous particles."

Production Examples A25 and A34

A particle having no porosity inside thereof below was prepared. For the resin particle A25, a crosslinked polymethyl methacrylate resin particle (trade name: MBX-30, made by SEKISUI PLASTICS CO., Ltd.) was used as it was. The resin particle A34 was a particle obtained by classifying the crosslinked polymethyl methacrylate resin particle and having a volume average particle size of 10.0 μm.

Production Example A26

To 300 parts by mass of deionized water, 10.5 parts by mass of tricalcium phosphate and 0.015 parts by mass of sodium dodecylbenzenesulfonate were added to prepare an aqueous medium. Next, 65 parts by mass of lauryl methacrylate, 30 parts by mass of ethylene glycol dimethacrylate, 0.04 parts by mass of poly(ethylene glycol-tetramethylene glycol) monomethacrylate, and 0.5 parts by mass of azobisisobutyronitrile were mixed to prepare an oily mixed solution. The oily mixed solution was dispersed in the aqueous medium at the number of rotation of 4800 rpm with a homomixer. Subsequently, the obtained solution was charged into a polymerization reaction container whose inside was replaced by nitrogen. While the solution was being stirred at 250 rpm, suspension polymerization was performed at 70° C. over 8 hours. After cooling, hydrochloric acid was added to the obtained suspension to decompose calcium phosphate. Further, filtration and washing with water were repeated. After drying at 80° C. for 5 hours, product was crushed and classified with a sonic classifier to obtain a resin particle A26 having an average particle size of 10.0 μm. The cross section of the particle was observed by the method above. The particle had a plurality of porosities with a size of approximately 300 nm inside thereof (hereinafter referred to as a "multi-hollow particle").

Production Example A27

For the resin particle A27, a crosslinked polymethyl methacrylate resin particle (trade name: MBP-8, made by SEKISUI PLASTICS CO., Ltd.) was used as it was. The volume average particle size was 8.1 μm. When the cross section of the particle was observed by the method above, it was revealed that the particle was a "multi-hollow particle" having a plurality of porosities with a size of approximately 300 nm inside thereof.

Production Example A28

A resin particle A28 was obtained in the same manner as in Production Example A26 except that the number of rotation of the homomixer was changed to 3600 rpm. The particle was a "multi-hollow particle."

Production Example A29

A resin particle A29 was obtained in the same manner as in Production Example A26 except that the amount of poly (ethylene glycol-tetramethylene glycol)monomethacrylate was changed to 0.15 parts by mass and the number of rotation of the homomixer was changed to 4000 pm. The particle was a "multi-hollow particle."

Production Example A30

A resin particle A30 was obtained in the same manner as in Production Example A28 except that the amount of poly (ethylene glycol-tetramethylene glycol)monomethacrylate was changed to 0.3 parts by mass. The particle was a "multi-hollow particle."

Production Example A31

To 300 parts by mass of deionized water, 20 parts by mass of tricalcium phosphate and 0.04 parts by mass of sodium dodecylbenzenesulfonate were added to prepare an aqueous medium. Next, 10 parts by mass of methyl acrylate, 81 parts by mass of styrene, 9 parts by mass of divinylbenzene, 0.8 parts by mass of azobisisobutyronitrile, and 1 part by mass of a surfactant (trade name: Solsperse 26000, made by Lubrizol Corporation) were mixed to prepare an oily mixed solution. The oily mixed solution was dispersed in the aqueous medium at the number of rotation of 4200 rpm with a homomixer. After that, the procedure was performed in the same manner as in Production Example A26 to obtain a resin particle A31 having an average particle size of 13.2 μm. The cross section of the particle was observed by the method above. The particle was a particle having a single hollow portion inside thereof (hereinafter referred to as a "single-hollow particle"). The hollow portion had a pore size of 3.8 μm.

Production Example A32

A resin particle A32 was obtained in the same manner as in Production Example A26 except that the amount of poly (ethylene glycol-tetramethylene glycol)monomethacrylate was changed to 0.2 parts by mass and the number of rotation of the homomixer was changed to 3900 pm. The particle was a "multi-hollow particle."

Production Example A33

For the resin particle A33, a heat expansive microcapsule (trade name: EXPANSEL930-120, made by Japan Fillite Co., Ltd.) was used as it was. The particle had an average particle size of 20.2 μm, and had no porosity inside thereof.

[Evaluation of Properties of Porous Particle and Others]

(1) Observation of Cross Section of Porous Particle

In the resin particles A1 to A24, the particle was observed using a visible light-curable embedding resin D-800 and ruthenium tetraoxide, and the porosity was clearly seen. At this time, the resin portion was seen in white, and the porosity portion was seen in black. In the resin particles A26 to A32, the resin portion was seen in white, and the porosity portion was seen in slightly grayish black.

(2) Other Evaluations

In the resin particles obtained in Production Examples A1 to A34, the volume average particle size, the porosity in the inner layer region and the outer layer region, and pore sizes in the inner layer region and the outer layer region were measured by the methods described above. The ratio of the porosity in the outer layer region to the porosity in the inner layer region and the ratio of the pore size in the outer layer region to the pore size in the outer layer region were calculated. These results are shown in Table 2. The shape of each resin particle (porous particle, solid particle, multi-hollow particle, or single-hollow particle) is also shown in Table 2.

TABLE 1

| Production Example | Polymerization monomer | Parts by mass | Crosslinkable monomer | Parts by mass | First porosifying agent | Parts by mass | Second porosifying agent | Parts by mass | The number of rotation of homomixer (ppm) |
|---|---|---|---|---|---|---|---|---|---|
| A1 | Methyl methacrylate | 38.0 | Ethylene glycol dimethacrylate | 26.0 | Normal hexane | 34.1 | Ethyl acetate | 8.5 | 2000 |
| A2 | Methyl methacrylate | 32.0 | Ethylene glycol dimethacrylate | 21.9 | Normal hexane | 43.1 | Ethyl acetate | 10.8 | 3600 |
| A3 | Butyl methacrylate | 38.0 | Ethylene glycol dimethacrylate | 26.0 | Normal hexane | 34.1 | Isopropyl acetate | 8.5 | 1400 |
| A4 | Methyl methacrylate | 32.0 | Ethylene glycol dimethacrylate | 21.9 | Normal hexane | 43.1 | Methyl acetate | 10.8 | 3600 |
| A5 | Methyl methacrylate | 32.0 | Ethylene glycol dimethacrylate | 21.9 | Normal hexane | 43.1 | Ethyl acetate | 10.8 | 3900 |
| A6 | Methyl methacrylate + styrene | 14.0 14.0 | 1,6-Hexanediol dimethacrylate | 19.2 | Normal hexane | 46.1 | Methyl acetate | 11.5 | 1900 |
| A7 | Methyl methacrylate | 28.0 | Ethylene glycol dimethacrylate | 19.2 | Normal hexane | 46.1 | Methyl acetate | 11.5 | 2800 |
| A8 | Methyl methacrylate | 28.0 | Ethylene glycol dimethacrylate | 19.2 | Normal hexane | 46.1 | Ethyl acetate | 11.5 | 1600 |
| A9 | Methyl methacrylate | 28.0 | Ethylene glycol dimethacrylate | 19.2 | Normal hexane | 46.1 | Methyl acetate | 11.5 | 1600 |
| A10 | Methyl methacrylate + Butyl methacrylate | 16.0 16.0 | Ethylene glycol dimethacrylate | 21.9 | Normal hexane | 43.1 | Isopropyl acetate | 10.8 | 1400 |
| A11 | Methyl methacrylate | 32.0 | Ethylene glycol dimethacrylate | 21.9 | Normal hexane | 43.1 | Isopropyl acetate | 10.8 | 2900 |
| A12 | Methyl methacrylate | 28.0 | Ethylene glycol dimethacrylate | 19.2 | Normal hexane | 46.1 | Isopropyl acetate | 11.5 | 1000 |
| A13 | Butyl methacrylate | 28.0 | Ethylene glycol dimethacrylate | 19.2 | Normal hexane | 46.1 | Methyl acetate | 11.5 | 3900 |
| A14 | Butyl methacrylate | 28.0 | Ethylene glycol dimethacrylate | 19.2 | Normal hexane | 46.1 | Methyl acetate | 11.5 | 1500 |
| A15 | Methyl methacrylate | 28.0 | Ethylene glycol dimethacrylate | 19.2 | Normal hexane | 46.1 | Ethyl acetate | 11.5 | 1000 |
| A16 | Methyl methacrylate | 28.0 | 1,6-Hexanediol dimethacrylate | 19.2 | Normal hexane | 46.1 | Methyl acetate | 11.5 | 800 |
| A17 | Methyl methacrylate | 28.0 | 1,6-Hexanediol dimethacrylate | 19.2 | Normal hexane | 46.1 | Methyl acetate | 11.5 | 4000 |
| A18 | Butyl methacrylate | 38.0 | 1,6-Hexanediol dimethacrylate | 26.0 | Normal hexane | 34.1 | Isopropyl acetate | 8.5 | 3500 |
| A19 | Methyl methacrylate + styrene | 20.0 18.0 | 1,6-Hexanediol dimethacrylate | 26.0 | Normal hexane | 34.1 | Isopropyl acetate | 8.5 | 800 |
| A20 | Methyl methacrylate + styrene | 20.0 5.0 | Ethylene glycol dimethacrylate | 17.1 | Normal hexane | 50.5 | Acetone | 12.6 | 4500 |
| A21 | Styrene | 25.0 | Ethylene glycol dimethacrylate | 17.1 | Normal hexane | 50.5 | Acetone | 12.6 | 3600 |
| A22 | Methyl methacrylate + styrene | 10.0 15.0 | Ethylene glycol dimethacrylate | 17.1 | Normal hexane | 50.5 | Acetone | 12.6 | 4600 |
| A23 | Styrene | 25.0 | Ethylene glycol dimethacrylate | 17.1 | Normal hexane | 50.5 | Acetone | 12.6 | 3800 |
| A24 | Styrene | 25.0 | Ethylene glycol dimethacrylate | 17.1 | Normal hexane | 50.5 | Acetone | 12.6 | 2800 |
| A27 | Methyl methacrylate | 33.0 | 1,6-Hexanediol dimethacrylate | 17.0 | Methyl acetate | 50 | — | — | 4800 |

TABLE 2

| Resin particle No. | Shape of particle | Volume average particle size (μm) | Inner layer region Pore size (nm) | Inner layer region Porosity (%) | Outer layer region Pore size (nm) | Outer layer region Porosity (%) | Outer layer portion/inner layer portion Pore size ratio | Outer layer portion/inner layer portion Porosity ratio (%) |
|---|---|---|---|---|---|---|---|---|
| A1 | Porous | 30.5 | 21 | 20 | 87 | 35 | 4.1 | 1.8 |
| A2 | Porous | 20.2 | 22 | 21 | 90 | 42 | 4.1 | 2.0 |
| A3 | Porous | 35.3 | 15 | 15 | 55 | 32 | 3.7 | 2.1 |
| A4 | Porous | 20.1 | 22 | 21 | 140 | 46 | 6.4 | 2.2 |
| A5 | Porous | 18.3 | 30 | 20 | 101 | 41 | 3.4 | 2.0 |
| A6 | Porous | 32.0 | 45 | 32 | 145 | 51 | 3.2 | 1.6 |
| A7 | Porous | 26.0 | 23 | 25 | 101 | 41 | 4.4 | 1.6 |
| A8 | Porous | 34.0 | 24 | 20 | 83 | 30 | 3.5 | 1.5 |
| A9 | Porous | 34.0 | 22 | 26 | 104 | 41 | 4.7 | 1.6 |
| A10 | Porous | 35.5 | 15 | 18 | 34 | 30 | 2.3 | 1.7 |
| A11 | Porous | 25.5 | 17 | 19 | 35 | 30 | 2.1 | 1.6 |
| A12 | Porous | 41.0 | 17 | 26 | 38 | 40 | 2.2 | 1.5 |
| A13 | Porous | 18.1 | 21 | 31 | 152 | 51 | 7.2 | 1.6 |
| A14 | Porous | 35.3 | 22 | 32 | 143 | 55 | 6.5 | 1.7 |
| A15 | Porous | 39.5 | 24 | 23 | 87 | 42 | 3.6 | 1.8 |
| A16 | Porous | 45.5 | 26 | 22 | 130 | 55 | 5.0 | 2.5 |
| A17 | Porous | 16.2 | 21 | 22 | 125 | 55 | 6.0 | 2.5 |
| A18 | Porous | 21.0 | 30 | 18 | 65 | 32 | 2.2 | 1.8 |
| A19 | Porous | 45.3 | 38 | 25 | 76 | 38 | 2.0 | 1.5 |
| A20 | Porous | 15.3 | 25 | 39 | 178 | 59 | 7.1 | 1.5 |
| A21 | Porous | 20.2 | 27 | 35 | 180 | 58 | 6.7 | 1.7 |
| A22 | Porous | 13.2 | 38 | 34 | 152 | 59 | 4.0 | 1.7 |
| A23 | Porous | 18.8 | 29 | 38 | 180 | 60 | 6.2 | 1.6 |
| A24 | Porous | 26.0 | 31 | 36 | 195 | 61 | 6.3 | 1.7 |
| A25 | Solid | 30.5 | — | 0 | — | 0 | — | — |
| A26 | Multi-hollow | 10.3 | 310 | 0.2 | 300 | 1 | 1.0 | 5.0 |
| A27 | Porous | 8.1 | 132 | 45 | 131 | 40 | 1.0 | 0.9 |
| A28 | Multi-hollow | 20.2 | 923 | 0.1 | 857 | 0.8 | 0.9 | 8.0 |
| A29 | Multi-hollow | 15.2 | 810 | 0.8 | 756 | 0.7 | 0.9 | 0.9 |
| A30 | Multi-hollow | 20.3 | 912 | 2 | 813 | 1.9 | 0.9 | 1.0 |
| A31 | Single-hollow | 13.2 | 3820 | 2.5 | — | 0 | — | 0.0 |
| A32 | Multi-hollow | 18.2 | 802 | 1.4 | 720 | 2.3 | 0.9 | 1.6 |
| A33 | Microcapsule | 20.2 | — | 0 | — | 0 | — | — |
| A34 | Solid particle | 10.0 | — | 0 | — | 0 | — | — |

3. Production Examples of Conductive Particle

Production Example B1

140 g of methyl hydrogen polysiloxane was added to 7.0 kg of a silica particle (average particle size: 15 nm, volume resistivity: $1.8\times10^{12}$ Ω·cm) while an edge runner was operated, and mixed and stirred at a line load of 588 N/cm (60 kg/cm) for 30 minutes. At this time, the stirring rate was 22 rpm. 7.0 kg of carbon black "#52" (trade name, made by Mitsubishi Chemical Corporation) was added to the mixture over 10 minutes while the edge runner was operated, and further mixed and stirred at a line load of 588 N/cm (60 kg/cm) over 60 minutes. Thus, carbon black was adhered to the surface of the silica particle coated with methyl hydrogen polysiloxane. Then, drying was performed at 80° C. for 60 minutes with a dryer to prepare a composite conductive fine particle. At this time, the stirring rate was 22 rpm. The obtained composite conductive fine particle had an average particle size of 15 nm and a volume resistivity of $1.1\times10^{2}$ Ω·cm.

4. Production Example of Insulation Particle

Production Example B2

110 g of isobutyltrimethoxysilane as a surface treatment agent and 3000 g of toluene as a solvent were blended with 1000 g of a needle-like rutile titanium oxide particle (average particle size: 15 nm, length:width=3:1, volume resistivity: $2.3\times10^{10}$ Ω·cm) to prepare a slurry. After the slurry was mixed with a stirrer for 30 minutes, the slurry was fed to a Visco Mill having glass beads having an average particle size of 0.8 mm filled up to 80% of the effective inner volume. Then, the slurry was wet crushed at a temperature of 35±5° C. Using a kneader, toluene was removed from the slurry obtained by the wet crushing by reduced pressure distillation (bath temperature: 110° C., product temperature: 30 to 60° C., reduced pressure degree: approximately 100 Torr). Then, a surface treatment agent was baked to the slurry at 120° C. for 2 hours. The baked particle was cooled to room temperature, and then ground using a pin mill to produce a surface treated titanium oxide particle. The surface treated titanium oxide particle obtained had an average particle size of 15 nm and a volume resistivity of $5.2\times10^{15}$ Ω·cm.

Example 1

1. Preparation of Electro-Conductive Substrate

A thermosetting adhesive containing 10% by mass of carbon black was applied to a stainless steel substrate having a diameter of 6 mm and a length of 244 mm, and dried. The obtained product was used as the electro-conductive substrate.

2. Preparation of Conductive Rubber Composition

Seven other materials shown in Table 3 below were added to 100 parts by mass of an epichlorohydrin rubber (EO-EP- AGE ternary copolymer, EO/EP/AGE=73 mol %/23 mol %/4 mol %), and kneaded for 10 minutes with a sealed type mixer adjusted at 50° C. to prepare a raw material compound.

TABLE 3

| Material | Amount in use (parts by mass) |
|---|---|
| Epichlorohydrin rubber (EO-EP-AGE ternary copolymer, EO/EP/AGE = 73 mol %/23 mol %/4 mol %) | 100 |
| Calcium carbonate (trade name: Silver-W, made by Shiraishi Kogyo Kaisha, Ltd.) | 80 |
| Adipic acid ester (trade name: POLYCIZER W305ELS, made by DIC Corporation) | 8 |
| Zinc stearate (trade name: SZ-2000, made by Sakai Chemical Industry Co., Ltd.) | 1 |
| 2-Mercaptobenzimidazole (MB) (antioxidant) | 0.5 |
| Zinc oxide (trade name: two zinc oxides, made by Sakai Chemical Industry Co., Ltd.) | 2 |
| Quaternary ammonium salt "ADK CIZER LV-70" (trade name, made by ADEKA Corporation) | 2 |
| Carbon black "Thermax Floform N990" (trade name, made by Cancarb Ltd., Canada, average particle size: 270 nm) | 5 |

EO: Ethylene oxide,
EP: Epichlorohydrin,
AGE: Allyl glycidyl ether 0.8 Parts by mass of sulfur as a vulcanizing agent and 1 part by mass of dibenzothiazyl sulfide (DM) and 0.5 parts by mass of tetramethyl thiuram monosulfide (TS) as vulcanization accelerators were added to the raw material compound. Next, the mixture was kneaded for 10 minutes with a two-roll mill whose temperature was cooled to 20° C. to prepare an electro-conductive rubber composition. At this time, the interval of the two-roll mill was adjusted to be 1.5 mm.

3. Preparation of Elastic Roller

Using an extrusion molding apparatus including a cross-head, the electro-conductive substrate was used as the center shaft, and its outer periphery was coaxially coated with the electro-conductive rubber composition to obtain a rubber roller. The thickness of the coating rubber composition was adjusted to be 1.75 mm.

After the rubber roller was heated at 160° C. for one hour in a hot air furnace, ends of the elastic layer were removed such that the length was 224 mm. Furthermore, the roller was secondarily heated at 160° C. for one hour to produce a roller including a preparative coating layer having a layer thickness of 1.75 mm.

The outer peripheral surface of the produced roller was polished using a plunge cutting mode cylinder polisher. A vitrified grinding wheel was used as the polishing grinding wheel. The abrasive grain was green silicon carbide (GC), and the grain size was 100 mesh. The number of rotation of the roller was 350 rpm, and the number of rotation of the polishing grinding wheel was 2050 rpm. The rotational direction of the roller was the same as the rotational direction of the polishing grinding wheel (following direction). The cutting speed was changed stepwise from 10 mm/min to 0.1 mm/min from a time when the grinding wheel is brought into contact with the unpolished roller to a time when the roller was polished to a diameter of 9 mm. The spark-out time (time at a cutting amount of 0 mm) was set 5 seconds. Thus, an elastic roller was prepared. The thickness of the elastic layer was adjusted to be 1.5 mm. The crown amount of the roller was 100 μm.

4. Preparation of Coating Solution for Forming Surface Layer

Methyl isobutyl ketone was added to a caprolactone-modified acrylic polyol solution "Placcel DC2016" (trade name, made by Daicel Corporation), and the solid content was adjusted to be 12% by mass. Four other materials shown in Component (1) in Table 9 below were added to 834 parts by mass of the solution (solid content of acrylic polyol: 100 parts by mass) to prepare a mixed solution.

Next, 188.5 g of the mixed solution was placed in a glass bottle having an inner volume of 450 mL, with 200 g of glass beads as a medium having an average particle size of 0.8 mm. Using a paint shaker dispersing machine, the mixed solution was dispersed for 48 hours. After dispersion, 7.2 g of the resin particle A1 was added. This is equivalent to 40 parts by mass of the resin particle B1 based on 100 parts by mass of solid content of the acrylic polyol. Subsequently, the resin particle A1 was dispersed for 5 minutes, and the glass beads were removed to prepare a coating solution for a surface layer. The specific gravity of the coating solution was 0.9110. The specific gravity was measured by putting a commercially available densimeter into the coating solution.

TABLE 4

| | Material | Amount in use (parts by mass) |
|---|---|---|
| Component (1) | Caprolactone-modified acrylic polyol solution (trade name: Placcel DC 2016, made by Daicel Corporation) | 100 |
| | Composite conductive fine particle (produced in Production Example B1) | 55 |
| | Surface treated titanium oxide particle (produced in Production Example B2) | 35 |
| | Modified dimethyl silicone oil (trade name: SH28PA, made by Dow Corning Toray Co., Ltd.) | 0.08 |
| | Block isocyanate mixture (7:3 mixture of butanone oxime block in hexamethylene diisocyanate (HDI) and that in isophorone diisocyanate (IPDI)) | 80.14 |
| Component (2) | Resin particle A1 | 40 |

5. Formation of Surface Layer

The elastic roller was directed in the longitudinal direction, vertically immersed in the coating solution, and coated by dipping. The immersion time was 9 seconds. The obtained coated product was air dried at 23° C. for 30 minutes, dried for 30 minutes with a hot air circulation drying oven at a temperature of 80° C., and further dried at a temperature of 160° C. for one hour to cure the coating. Thus, a charging roller 1 having an elastic layer and surface layer formed in the outer peripheral portion of the electro-conductive substrate was obtained. The film thickness of the surface layer was 4.9 μm. The film thickness of the surface layer was measured in a portion wherein no resin particle existed.

6. Measurement of Values of a Variety of Properties of Resin Particle Included in Surface Layer The volume average particle size of the resin particle, the porosity Vt of the entire resin particle, the porosity $V_{11}$ of the "vertex side region of the protrusion," and the pore size in the "vertex side region of the protrusion" were measured by the methods described above. The results are shown in Table 8.

7. Measurement of Electric Resistance of Charging Roller

The electric resistance value of the charging roller 1 was measured by the method described above. The results are shown in Table 8.

8. Evaluation of Image

A monochrome laser printer ("LBP6300" (trade name)) made by Canon Inc. was used as the electrophotographic apparatus having the configuration shown in FIG. 10, and voltage was applied to the charging member from the outside. The voltage applied was a superimposed voltage of AC and DC. The AC voltage had a peak to peak voltage (Vpp) of 1400 V and a frequency (f) of 1350 Hz. The DC voltage (Vdc) was −560V. An image was output at a resolution of 600 dpi. The process cartridge for a printer was used as the process cartridge.

Figure 11:
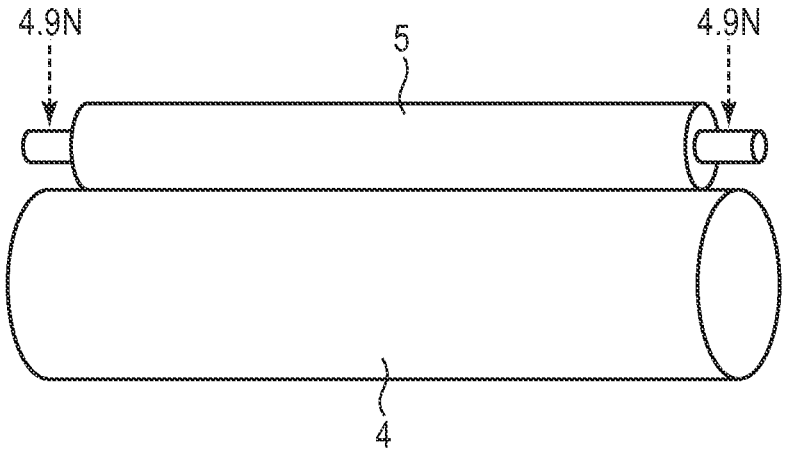
FIG. 11 is a schematic view illustrating a contact state of the charging roller and the electrophotographic photosensitive member.

First, the toner attached was completely extracted from the process cartridge. The toner attached was extracted from the process cartridge for the monochrome laser printer ("LBP6300" (trade name)) made by Canon Inc., and a toner having the same mass as that of the toner extracted from the process cartridge was charged in the process cartridge. Furthermore, the charging roller attached was removed from the process cartridge, and the charging roller 1 was mounted on the process cartridge. As shown in FIG. 11, the charging roller was brought into contact with the electrophotographic photosensitive member with springs. The pressure of 4.9 N was applied to one end of the electrophotographic photosensitive member, and the pressure of 9.8 N in total was applied to both ends thereof.

The process cartridge stood for 24 hours in each of an environment 1 (environment of temperature: 7.5° C., relative humidity: 30%), an environment 2 (environment of temperature: 15° C., relative humidity: 10%), and an environment 3 (environment of temperature: 23° C., relative humidity: 50%). Subsequently, an electrophotographic image was formed in each of the environments.

In the formation of the electrophotographic image, 10,000 sheets of an image were output in which a horizontal line at a width of 2 dots and an interval of 186 dots was drawn in a direction perpendicular to the rotational direction of the electrophotographic photosensitive member. The 10,000 sheets were output on the conditions wherein the number of outputs was 2,500 sheets per day, and the rotation of the printer was paused for 3 seconds every two outputs. Here, one sheet of a solid white image and one sheet of a halftone image were output at each of the beginning of the day after the 2,500th sheet of the horizontal line image was output, the beginning of the day after the 5,000th sheet was output, the beginning of the day after the 7,500th sheet was output, and the beginning of the day after the 10,000th sheet was output.

The halftone image refers to an image in which a horizontal line at a width of one dot and an interval of two dots was drawn in the direction perpendicular to the rotational direction of the electrophotographic photosensitive member. The thus-obtained solid white images and halftone images were visually observed. The solid white image was evaluated for an image with vertical streaks and the halftone image was evaluated for an image with horizontal streaks. The evaluation was determined based on the following criteria:

Rank 1; no image with vertical streaks and no image with horizontal streaks are found.

Rank 2; an image with slight vertical streaks and an image with slight horizontal streaks are found.

Rank 3; an image with vertical streaks and an image with horizontal streaks are partially found at the pitch of the charging roller, but are no problem in practice.

Rank 4; an image with remarkable vertical streaks and an image with remarkable horizontal streaks are found, and the quality of the image is reduced.

The results of evaluation are shown in Table 9. In Table 9, images No. 1 to No. 4 refer to the solid white images output after the 2,500th sheet was output, after the 5,000th sheet was output, after the 7,500th sheet was output, and after the 10,000th sheet was output, respectively. Images No. 5 to No. 8 refer to the halftone images output after the 2,500th sheet was output, after the 5,000th sheet was output, after the 7,500th sheet was output, and after the 10,000th sheet was output, respectively.

Reduction in the discharge intensity within the nip of the charging roller in the step of forming an electrophotographic image may produce the image with horizontal streaks. The evaluation of the image is for checking the correlation between the effect of suppressing reduction in the discharge intensity within the nip and the quality of the electrophotographic image.

9. Examination of Discharge Intensity within the Nip (Evaluation B)

Figure 6:
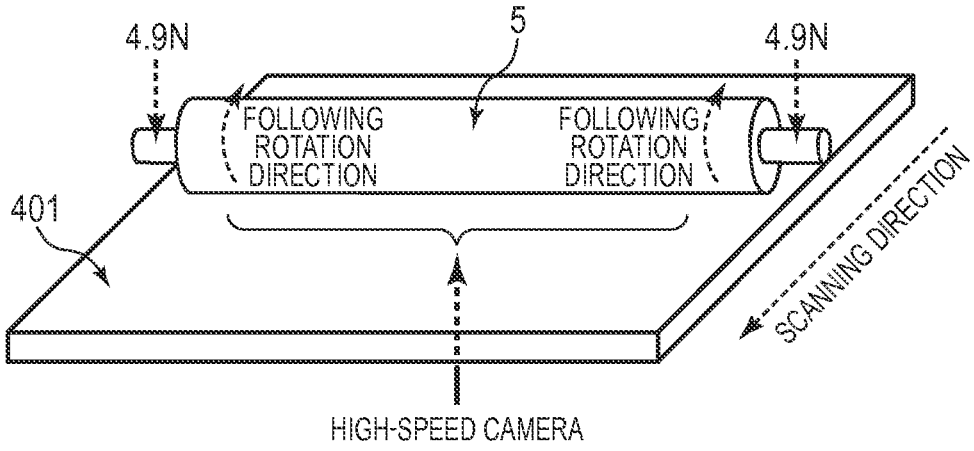
FIG. 6 is a schematic view illustrating an apparatus used in observation of discharge in a nip formed by the charging roller.

A 5 μm ITO film was formed on the surface of a glass plate (length: 300 mm, width: 240 mm, thickness: 4.5 mm), and further a 17 μm charge-transport layer alone was formed thereon. As illustrated in FIG. 6, a tool enabling a charging roller 5 to contact the surface of a glass plate 401 after film formation at a pressure of 4.9 N in one end and 9.8 N in total in both ends by press of the spring was produced. Furthermore, a glass plate 401 could be scanned at the same speed as that in the monochrome laser printer (trade name: "LBP6300", made by Canon Inc.).

Considering the glass plate 401 as the electrophotographic photosensitive member, the tool shown in FIG. 6 was observed from under the contact region (the side opposite to the front surface of the glass plate 401) via a high-speed gate I.I. unit C9527-2 (product name, made by Hamamatsu Photonics K.K.) with a high-speed camera FASTCAM-SA 1.1 (product name, made by Hamamatsu Photonics K.K.). Thereby, the discharge intensity within the nip of the charging roller was examined. The voltage applied to the charging roller had the same conditions as those in the evaluation of the image (evaluation of durability).

First, the charging roller before the evaluation of durability was observed, and the charging roller after the evaluation of durability was observed. Thereby, it was checked whether the discharge intensity within the nip could be kept, and the correlation with the quality of the electrophotographic image was examined.

The discharge within the nip was photographed at a photographing rate of 3000 fps for approximately 0.3 seconds. The moving picture was averaged into an image, and the image was output. In photographing, the sensitivity was properly adjusted, and the brightness of the image to be taken was adjusted. The output images were compared before and after the evaluation of durability, and determined based on the following criteria:

Rank 1; no change in the discharge intensity within the nip is found before and after the evaluation of durability.

Rank 2; slight change in the discharge intensity within the nip is found before and after the evaluation of durability.

Rank 3; reduction in the discharge intensity within the nip is found within part of the nip before and after the evaluation of durability.

Rank 4; the discharge within the nip hardly occurs after the evaluation of durability.

The results of evaluation are shown in Table 9. The environment for observing the discharge within the nip was the environment 2. This is because the environment 2 was an environment having the lowest humidity in which the electric resistance value of the charging roller was most ununiform. The glass plate for observation and the charging member stood in the environment 2, and observed immediately after these were taken out of the environment 2.

Examples 2 to 5

Charging members 2 to 5 were obtained in the same manner as in Example 1 except that the kind of resin particles was changed as shown in Table 8.

Example 6

A charging member 6 was obtained in the same manner as in Example 5 except that in the formation of the surface layer, drying at a temperature of 160° C. for one hour was changed to drying at a temperature 170° C. for one hour.

Example 7

1. Preparation of Surface Layer Coating Solution

Methyl isobutyl ketone was added to a caprolactone-modified acrylic polyol solution "Placcel DC2016" (trade name, made by Daicel Corporation) to adjust the solid content to be 11% by mass. Four other materials shown in Component (1) in Table 5 below were added to 714 parts by mass of the solution (acrylic polyol solid content: 100 parts by mass) to prepare a mixed solution. At this time, the block isocyanate mixture had an amount of isocyanate at "NCO/OH=1.0."

Next, 187 g of the mixed solution and 200 g of glass beads as a medium having an average particle size of 0.8 mm were placed in a glass bottle having an inner volume of 450 mL, and dispersed for 48 hours using a paint shaker dispersing machine. After dispersion, 8.25 g of the resin particle A6 was added. The ratio was 50 parts by mass of the resin particle A6 based on 100 parts by mass of the acrylic polyol solid content. Subsequently, the mixture was dispersed for 5 minutes, and the glass beads were removed to prepare a coating solution for a surface layer. The specific gravity of the coating solution was 0.9000. A charging member 7 was obtained in the same manner as in Example 1 except these.

TABLE 5

| | Material | Amount in use (parts by mass) |
|---|---|---|
| Component (1) | Caprolactone-modified acrylic polyol solution (trade name: Placcel DC 2016, made by Daicel Corporation) | 100 |

TABLE 5-continued

| | Material | Amount in use (parts by mass) |
|---|---|---|
| | Carbon black "#52" (trade name, made by Mitsubishi Chemical Corporation) | 25 |
| | Surface treated titanium oxide particle (produced in Production Example B2) | 25 |
| | Modified dimethyl silicone oil (trade name: SH28PA, made by Dow Corning Toray Co., Ltd.) | 0.08 |
| | Block isocyanate mixture (7:3 mixture of butanone oxime block in hexamethylene diisocyanate (HDI) and that in isophorone diisocyanate (IPDI)) | 80.14 |
| Component (2) | Resin particle A6 | 50 |

Examples 8 to 13

Charging members 8 to 13 were obtained in the same manner as in Example 7 except that the kind of resin particles was changed as shown in Table 8.

Example 14

A charging member 14 was obtained in the same manner as in Example 6 except that the kind of resin particles was changed as shown in Table 8.

Examples 15 to 21

Charging members 15 to 21 were obtained in the same manner as in Example 1 except that the kind of resin particles was changed as shown in Table 8.

Example 22

1. Production of Elastic Roller

An elastic roller was obtained in the same manner as in Example 1 except that an epichlorohydrin rubber (EO-EP-AGE ternary compound, EO/EP/AGE=56 mol %/40 mol %/4 mol %) was used as the epichlorohydrin rubber.

2. Preparation of Coating Solution for Surface Layer

Methyl isobutyl ketone was added to polyvinyl butyral "S-LEC B" (trade name, made by Sekisui Chemical Co., Ltd.) to adjust the solid content to be 10% by mass. Three other materials shown in Component (1) in Table 6 below were added to 1000 parts by mass of the solution (polyvinyl butyral solid content: 100 parts by mass) to prepare a mixed solution.

Next, 170 g of the mixed solution and 200 g of glass beads as a medium having an average particle size of 0.8 mm were placed in a glass bottle having an inner volume of 450 mL, and dispersed for 30 hours using a paint shaker dispersing machine. After dispersion, 7.5 g of the resin particle A20 was added. The ratio was 50 parts by mass of the resin particle A20 based on 100 parts by mass of the acrylic polyol solid content. Subsequently, the mixture was dispersed for 5 minutes, and the glass beads were removed to prepare a coating solution for a surface layer. The specific gravity of the coating solution was 0.9100.

After that, a charging member 22 was obtained in the same manner as in Example 21 except that the elastic roller and the coating solution for a surface layer above were used and the final drying temperature of the surface layer coating was changed to 130° C.

TABLE 6

| | Material | Amount in use (parts by mass) |
|---|---|---|
| Component (1) | Polyvinyl butyral "S-LEC B" (trade name, made by Sekisui Chemical Co., Ltd.) | 100 |
| | Carbon black "#52" (trade name, made by Mitsubishi Chemical Corporation) | 30 |
| | Surface treated titanium oxide particle (produced in Production Example B2) | 30 |
| | Modified dimethyl silicone oil (trade name: SH28PA, made by Dow Corning Toray Co., Ltd.) | 0.08 |
| Component (2) | Resin particle A20 | 50 |

Example 23

A charging member 23 was obtained in the same manner as in Example 22 except that the kind of resin particles was changed as shown in Table 8.

Example 24

1. Production of Elastic Roller

Four other materials shown in Table 7 below were added to 100 parts by mass of an acrylonitrile butadiene rubber (NBR) (trade name: N230SV, made by JSR Corporation), and the mixture was kneaded for 15 minutes using a sealed type mixer adjusted at 50° C. to prepare a raw material compound. 1.2 parts by mass of sulfur as a vulcanizing agent and 4.5 parts by mass of tetrabenzyl thiuram disulfide (TBzTD) (trade name: Perka Cit TBzTD, made by FLEXSYS Inc.) as a vulcanization accelerator were added to the raw material compound, and kneaded for 10 minutes with a two-roll mill cooled to a temperature of 25° C. to prepare an electro-conductive rubber composition. After that, a charging member 24 was obtained in the same manner as in Example 7 except that the kind of resin particles was changed as shown in Table 8.

TABLE 7

| Material | Amount in use (parts by mass) |
|---|---|
| Acrylonitrile butadiene rubber (NBR) (trade name: N230SV, made by JSR Corporation) | 100 |
| Carbon black (trade name: SEAST S, made by Tokai Carbon Co., Ltd.) | 65 |
| Zinc stearate (trade name: SZ-2000, made by Sakai Chemical Industry Co., Ltd.) | 1 |
| Zinc oxide (trade name: two zinc oxides, made by Sakai Chemical Industry Co., Ltd.) | 5 |
| Calcium carbonate (trade name: Silver-W, made by Shiraishi Kogyo Kaisha, Ltd.) | 20 |

Examples 25 and 26

Charging members 25 and 26 were obtained in the same manner as in Example 24 except that the kind of resin particles was changed as shown in Table 8.

Various Evaluations in Examples 2 to 26

In the protrusion of the charging member, the volume average particle size of the resin particle, the porosity Vt of the entire resin particle, the porosity $V_{11}$ of the "vertex side region of the protrusion," and the pore size in the "vertex side region of the protrusion" were measured in the same manner as in Example 1. In all the Examples, it was found that the resin particles satisfy the conditions on the porosity according to the present invention.

The specific gravity of the coating solution for a surface layer and the film thickness of the surface layer were measured. Durability was evaluated, and the discharge intensity within the nip was examined along with this. The electric resistance value of the charging roller was measured. The results of evaluations are shown in Table 8 or Table 9.

Comparative Example 1

A charging member C1 was obtained in the same manner as in Example 22 except that the resin particle A25 (solid particle) was used instead of the resin particle A20. The protrusion in the charging member had no porosity.

Comparative Example 2

A charging member C2 was obtained in the same manner as in Comparative Example 1 except that the resin particle A26 was used instead of the resin particle A25 (solid particle). In the charging member, the resin particle did not satisfy the conditions of the porosity according to the present invention.

Comparative Example 3

A charging member C3 was obtained in the same manner as in Comparative Example 1 except that the resin particle A27 was used instead of the resin particle A25 (solid particle). The protrusion in the charging member had no porosity.

Comparative Examples 4 and 5

Charging members C4 and C5 were obtained in the same manner as in Comparative Example 1 except that the resin particle A28 or A29 was used instead of the resin particle A25 (solid particle). In the charging member, the resin particle did not satisfy the conditions on the porosity according to the present invention.

Comparative Examples 6 to 8

Charging members C6 to C8 were obtained in the same manner as in Example 24 except that the resin particles A30 to A32 were used instead of the resin particle A22. In the charging member, the resin particle did not satisfy the conditions on the porosity according to the present invention.

Comparative Example 9

The same elastic roller as that in Comparative Example 6 was used. For the coating solution for a surface layer, the solvent used in the coating solution for a surface layer in Example 22, i.e. methyl isobutyl ketone was changed to methyl ethyl ketone. Instead of the resin particle A20, the resin particle A33 (microcapsule) was used, and the amount was changed to 20 parts by mass.

After that, a charging member C9 was obtained in the same manner as in Example 22 except that the final drying temperature of the surface layer coating was changed to 160° C. and the drying time was changed to 30 minutes. In Comparative Example 9, the resin particle A33 expanded at the final drying temperature to form the protrusion derived from the "single-hollow particle" in the surface of the charging member. The resin particle did not satisfy the conditions on the porosity according to the present invention.

Comparative Example 10

A charging member C10 was obtained in the same manner as in Example 22 except that the resin particle A34 (solid particle) was used instead of the resin particle A20. The protrusion in the charging member had no porosity.

Comparative Example 11

A charging member C11 was obtained in the same manner as in Comparative Example 9 except that the final drying temperature of the surface layer coating was changed to 140° C. In Comparative Example 11, similarly to Comparative example 9, the protrusion derived from the single-hollow particle was formed in the surface of the charging member. In the charging member, the resin particle did not satisfy the conditions on the porosity according to the present invention.

Various Evaluations in Comparative Examples 1 to 11

The specific gravity of the coating solution for a surface layer and the film thickness of the surface layer were measured. Durability was evaluated, and the discharge intensity within the nip was examined along with this. The electric resistance value of the charging roller was measured. The results of evaluations are shown in Table 8 or Table 9.

TABLE 8

| | | Volume | Porosity (% by volume) | | Pore size (nm) | | | Specific gravity of | Film |
|---|---|---|---|---|---|---|---|---|---|
| | Resin particle | average particle size (μm) | Entire particle | Vertex side region of the protrusion | Inner layer region | Vertex side region of the protrusion | Electric resistance $\Omega \times 10^5$ | surface layer coating solution | thickness of surface layer (μm) |
| Example | 1 A1 | 29.9 | 0.91 | 6 | 44 | 96 | 5.0 | 0.9110 | 4.9 |
| | 2 A2 | 20.1 | 1.2 | 9 | 46 | 99 | 4.3 | 0.9110 | 5.0 |
| | 3 A3 | 32.3 | 0.72 | 5.5 | 32 | 61 | 5.3 | 0.9110 | 5.1 |
| | 4 A4 | 20.0 | 1.6 | 12 | 46 | 145 | 4.3 | 0.9110 | 4.2 |
| | 5 A5 | 18.2 | 1.5 | 7 | 63 | 111 | 4.2 | 0.9115 | 4.2 |
| | 6 A5 | 18.2 | 1.43 | 10 | 63 | 111 | 4.3 | 0.9115 | 4.3 |
| | 7 A6 | 29.8 | 2 | 15 | 95 | 150 | 6.4 | 0.9000 | 5.5 |
| | 8 A7 | 25.0 | 1.8 | 10 | 48 | 111 | 6.8 | 0.9000 | 5.6 |
| | 9 A8 | 35.4 | 1.8 | 7 | 50 | 91 | 6.5 | 0.9000 | 5.7 |
| | 10 A9 | 33.9 | 2 | 10 | 46 | 114 | 6.3 | 0.9000 | 5.8 |
| | 11 A10 | 35.3 | 1.1 | 5.1 | 23 | 37 | 6.2 | 0.9000 | 6.1 |
| | 12 A11 | 24.9 | 1.6 | 5.4 | 26 | 39 | 5.9 | 0.9000 | 5.4 |
| | 13 A12 | 40.0 | 2.1 | 5.3 | 26 | 42 | 6.1 | 0.9000 | 5.9 |
| | 14 A13 | 18.1 | 2.3 | 14 | 44 | 167 | 5.0 | 0.9105 | 4.9 |
| | 15 A13 | 18.0 | 2.3 | 12 | 44 | 167 | 4.3 | 0.9100 | 5.1 |
| | 16 A14 | 35.2 | 2.1 | 13 | 46 | 157 | 5.3 | 0.9100 | 5.3 |
| | 17 A15 | 39.1 | 2.4 | 8 | 50 | 96 | 4.3 | 0.9100 | 4.8 |
| | 18 A16 | 45.2 | 2.3 | 12 | 55 | 143 | 6.3 | 0.9100 | 5.7 |
| | 19 A17 | 16.0 | 2.2 | 10 | 32 | 138 | 4.3 | 0.9105 | 6.1 |
| | 20 A18 | 20.5 | 0.63 | 5.2 | 45 | 72 | 6.7 | 0.9100 | 6.0 |
| | 21 A19 | 45.0 | 2.4 | 5.4 | 57 | 84 | 6.9 | 0.9100 | 6.1 |
| | 22 A20 | 15.0 | 2.3 | 18 | 38 | 196 | 5.8 | 0.9105 | 5.8 |
| | 23 A21 | 20.0 | 2.2 | 19 | 41 | 198 | 5.3 | 0.9105 | 5.3 |
| | 24 A22 | 13.1 | 2.1 | 16 | 57 | 167 | 5.8 | 0.9005 | 3.8 |
| | 25 A23 | 18.1 | 2.2 | 19 | 44 | 198 | 5.6 | 0.9010 | 3.9 |
| | 26 A24 | 25.0 | 2.4 | 20 | 47 | 200 | 8.7 | 0.9005 | 4.0 |
| Example | 1 A25 | 30.1 | 0 | 0 | — | — | 6.9 | 0.9100 | 5.8 |
| Comparative | 2 A26 | 10.2 | 0.2 | 1 | 310 | 300 | 6.8 | 0.9105 | 6.3 |
| Example | 3 A27 | 8.3 | 0.8 | 0 | 105 | 0 | 5.8 | 0.9110 | 6.2 |
| | 4 A28 | 20.3 | 0.1 | 0.8 | 923 | 857 | 6.8 | 0.9100 | 4.1 |
| | 5 A29 | 15.0 | 0.8 | 0.7 | 810 | 756 | 6.5 | 0.9105 | 5.7 |
| | 6 A30 | 20.3 | 2 | 1.9 | 912 | 813 | 6.3 | 0.9100 | 4.3 |
| | 7 A31 | 13.0 | 2.5 | 0 | 3820 | — | 6.2 | 0.9105 | 5.2 |
| | 8 A32 | 18.2 | 1.4 | 2.3 | 802 | 720 | 6.1 | 0.9105 | 5.6 |
| | 9 A33 | 50.0 | 84 | 86 | 4820 | — | 7.2 | 0.8950 | 4.0 |
| | 10 A34 | 10.3 | 0 | 0 | — | — | 5.9 | 0.9010 | 4.5 |
| | 11 A33 | 10.2 | 74 | 76 | 9530 | — | 5.5 | 0.8950 | 5.1 |

TABLE 9

| | | Evaluation of image | | | | | | | | | | | | | | | | | | | | | | | | Discharge intensity |
|---|---|---|---|---|---|---|---|---|---|---|---|---|---|---|---|---|---|---|---|---|---|---|---|---|---|---|
| | | Environment 1/ image No. | | | | | | | | Environment 2/ image No. | | | | | | | | Environment 3/ image No. | | | | | | | | |
| | | 1 | 2 | 3 | 4 | 5 | 6 | 7 | 8 | 1 | 2 | 3 | 4 | 5 | 6 | 7 | 8 | 1 | 2 | 3 | 4 | 5 | 6 | 7 | 8 | within nip |
| Example | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| | 2 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| | 3 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| | 4 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| | 5 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| | 6 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| | 7 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| | 8 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| | 9 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| | 10 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| | 11 | 2 | 2 | 2 | 2 | 1 | 1 | 1 | 1 | 1 | 1 | 2 | 2 | 1 | 1 | 1 | 1 | 1 | 1 | 1 | 2 | 1 | 1 | 1 | 1 | 1 |
| | 12 | 2 | 2 | 2 | 2 | 1 | 1 | 1 | 2 | 1 | 1 | 2 | 2 | 1 | 1 | 1 | 2 | 1 | 1 | 1 | 2 | 1 | 1 | 1 | 2 | 1 |
| | 13 | 2 | 2 | 2 | 2 | 1 | 1 | 1 | 1 | 1 | 1 | 2 | 2 | 1 | 1 | 1 | 1 | 1 | 1 | 1 | 2 | 1 | 1 | 1 | 1 | 1 |
| | 14 | 1 | 1 | 1 | 1 | 2 | 2 | 2 | 2 | 1 | 1 | 1 | 1 | 2 | 2 | 2 | 2 | 1 | 1 | 1 | 1 | 2 | 2 | 2 | 2 | 2 |
| | 15 | 1 | 1 | 1 | 1 | 2 | 2 | 2 | 2 | 1 | 1 | 1 | 1 | 2 | 2 | 2 | 2 | 1 | 1 | 1 | 1 | 2 | 2 | 2 | 2 | 2 |
| | 16 | 1 | 1 | 1 | 1 | 2 | 2 | 2 | 2 | 1 | 1 | 1 | 1 | 1 | 1 | 2 | 2 | 1 | 1 | 1 | 1 | 1 | 2 | 2 | 2 | 2 |
| | 17 | 2 | 2 | 1 | 1 | 1 | 2 | 2 | 2 | 2 | 2 | 1 | 1 | 1 | 1 | 2 | 2 | 1 | 1 | 1 | 1 | 1 | 2 | 2 | 2 | 2 |
| | 18 | 1 | 1 | 1 | 1 | 2 | 2 | 2 | 2 | 1 | 1 | 1 | 1 | 1 | 1 | 2 | 2 | 1 | 1 | 1 | 1 | 1 | 2 | 2 | 2 | 2 |
| | 19 | 1 | 1 | 1 | 1 | 2 | 2 | 2 | 2 | 1 | 1 | 1 | 1 | 2 | 2 | 2 | 2 | 1 | 1 | 1 | 1 | 2 | 2 | 2 | 2 | 2 |
| | 20 | 3 | 3 | 2 | 2 | 1 | 1 | 1 | 1 | 3 | 3 | 2 | 2 | 1 | 1 | 1 | 1 | 2 | 2 | 2 | 2 | 1 | 1 | 1 | 1 | 1 |
| | 21 | 3 | 3 | 2 | 2 | 1 | 2 | 2 | 2 | 3 | 3 | 2 | 2 | 2 | 2 | 2 | 2 | 2 | 2 | 2 | 2 | 1 | 1 | 2 | 2 | 2 |
| | 22 | 2 | 2 | 3 | 2 | 3 | 3 | 3 | 3 | 2 | 2 | 3 | 2 | 3 | 3 | 3 | 3 | 2 | 2 | 2 | 2 | 2 | 2 | 3 | 3 | 3 |
| | 23 | 2 | 2 | 3 | 2 | 2 | 3 | 3 | 3 | 2 | 2 | 3 | 2 | 2 | 2 | 3 | 3 | 2 | 2 | 2 | 2 | 2 | 2 | 3 | 3 | 3 |
| | 24 | 2 | 2 | 3 | 3 | 2 | 3 | 3 | 3 | 2 | 2 | 3 | 3 | 3 | 3 | 3 | 3 | 2 | 2 | 2 | 2 | 2 | 2 | 3 | 3 | 3 |
| | 25 | 2 | 2 | 3 | 3 | 3 | 3 | 3 | 3 | 2 | 2 | 3 | 3 | 3 | 3 | 3 | 3 | 2 | 2 | 2 | 2 | 2 | 2 | 3 | 3 | 3 |
| | 26 | 2 | 2 | 3 | 3 | 3 | 3 | 3 | 3 | 2 | 2 | 3 | 3 | 3 | 3 | 3 | 3 | 2 | 2 | 2 | 2 | 2 | 2 | 3 | 3 | 3 |
| Comparative Example | 1 | 4 | 4 | 4 | 4 | 1 | 3 | 3 | 3 | 4 | 4 | 4 | 4 | 1 | 2 | 2 | 2 | 4 | 3 | 3 | 3 | 1 | 2 | 2 | 3 | 3 |
| | 2 | 4 | 4 | 4 | 4 | 4 | 4 | 4 | 4 | 4 | 4 | 4 | 4 | 4 | 4 | 4 | 4 | 4 | 3 | 3 | 3 | 3 | 3 | 4 | 4 | 4 |
| | 3 | 4 | 4 | 3 | 4 | 4 | 4 | 4 | 4 | 4 | 4 | 3 | 3 | 4 | 4 | 4 | 4 | 3 | 3 | 3 | 3 | 3 | 4 | 4 | 4 | 4 |
| | 4 | 4 | 4 | 3 | 4 | 1 | 2 | 2 | 3 | 4 | 4 | 4 | 4 | 1 | 2 | 2 | 2 | 4 | 3 | 3 | 3 | 1 | 2 | 2 | 3 | 3 |
| | 5 | 4 | 4 | 4 | 4 | 2 | 2 | 3 | 3 | 4 | 4 | 3 | 3 | 2 | 2 | 3 | 3 | 4 | 3 | 3 | 3 | 1 | 2 | 3 | 3 | 3 |
| | 6 | 4 | 4 | 3 | 4 | 1 | 1 | 2 | 3 | 4 | 4 | 4 | 4 | 1 | 1 | 2 | 3 | 3 | 3 | 3 | 3 | 1 | 1 | 2 | 3 | 3 |
| | 7 | 4 | 4 | 4 | 4 | 2 | 2 | 2 | 3 | 4 | 4 | 3 | 3 | 2 | 2 | 2 | 3 | 3 | 3 | 3 | 3 | 1 | 2 | 2 | 3 | 3 |
| | 8 | 4 | 4 | 4 | 4 | 2 | 2 | 3 | 3 | 4 | 4 | 4 | 4 | 2 | 2 | 3 | 3 | 4 | 3 | 3 | 3 | 1 | 2 | 3 | 3 | 3 |
| | 9 | 2 | 3 | 4 | 2 | 4 | 4 | 4 | 4 | 2 | 2 | 3 | 2 | 3 | 3 | 4 | 4 | 2 | 2 | 3 | 3 | 2 | 3 | 3 | 4 | 4 |
| | 10 | 4 | 4 | 3 | 4 | 4 | 4 | 4 | 4 | 3 | 4 | 3 | 4 | 4 | 4 | 4 | 4 | 3 | 4 | 4 | 4 | 4 | 4 | 4 | 4 | 4 |
| | 11 | 2 | 4 | 3 | 2 | 4 | 4 | 4 | 4 | 2 | 3 | 3 | 2 | 4 | 4 | 4 | 4 | 2 | 3 | 3 | 2 | 2 | 3 | 3 | 4 | 4 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-014877, filed Jan. 29, 2013, Japanese Patent Application No. 2013-131729, filed Jun. 24, 2013, and Japanese Patent Application No. 2013-152790, filed Jul. 23, 2013, which are hereby incorporated by reference herein in their entirety.

What is claimed is:

1. A charging member comprising:

an electro-conductive substrate and an electro-conductive surface layer, wherein:

the surface layer comprises a binder resin, an electro-conductive particle dispersed in the binder resin; and resin particles that roughen a surface of the surface layer, the surface being the surface of the surface layer farthest away from the electro-conductive substrate;

the surface of the surface layer has a plurality of protrusions each derived from the resin particles;

each of the resin particles that forms each of the protrusions has a pore inside thereof, has a porosity Vt of 2.5% by volume or less as a whole, and has a region whose porosity $V_{11}$ is 5% by volume or more and 20% by volume or less, wherein the region is farthest away from the electro-conductive substrate in each of the resin particles, and assuming that each of the resin particles is a solid particle having no pores, the region corresponds to an 11% by volume-occupying region of the solid particle.

2. The charging member according to claim 1, wherein the porosity V11 is 5.5% by volume or more and 15% by volume or less.

3. The charging member according to claim 1, wherein a pore size $R_{11}$ in the region of each of the resin particles, that corresponds to the 11% by volume-occupying region of the solid particle, is 30 nm or more and 200 nm or less as a mean pore size.

4. The charging member according to claim 3, wherein the pore size R11 is 60 nm or more and 150 nm or less as the mean pore size.

5. The charging member according to claim 1, wherein the charging member has a ten-point height of irregularities (Rzjis) of 8 μm or more and 100 μm or less.

6. The charging member according to claim 1, wherein the charging member has concavities between the protrusions and has an average interval between the concavities and the protrusions of the surface RSm of 20 μm or more and 300 μm or less.

7. The charging member according to claim 1, wherein the electro-conductive particle has an average particle size of 5 nm or more and 300 nm or less.

8. The charging member according to claim 1, wherein each of the resin particles is formed of one or more resins selected from the group consisting of acrylic resin, styrene resin, and acrylic styrene resin.

9. The charging member according to claim 1, wherein a content of the resin particles in the surface layer is 2 parts by mass or more and 100 parts by mass or less based on 100 parts by mass of the binder resin.

10. The charging member according to claim 9, wherein the content of the resin particles in the surface layer is 5 parts by mass or more and 80 parts by mass or less based on 100 parts by mass of the binder resin.

11. The charging member according to claim 1, wherein the resin particles have a volume average particle size of 10 μm or more and 50 μm or less.

12. A process cartridge detachably mountable on a main body of an electrophotographic apparatus, wherein the charging member according to claim 1 is integrated with at least a member to be charged.

13. An electrophotographic apparatus comprising the charging member according to claim 1 and a member to be charged.

* * * * *